US010930423B1

(12) United States Patent
Folker et al.

(10) Patent No.: US 10,930,423 B1
(45) Date of Patent: Feb. 23, 2021

(54) SINGLE MAGNETIC ASSEMBLY COMBINING THREE INDEPENDENT MAGNETICS USING A MODIFIED "E" CORE WITH FOUR WINDING WINDOWS

(71) Applicant: Universal Lighting Technologies, Inc., Madison, AL (US)

(72) Inventors: Donald Folker, Madison, AL (US); Mike LeBlanc, Huntsville, AL (US); Thomas M. Poehlman, Madison, AL (US); Wei Xiong, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 302 days.

(21) Appl. No.: 16/023,777

(22) Filed: Jun. 29, 2018

Related U.S. Application Data

(60) Provisional application No. 62/528,742, filed on Jul. 5, 2017.

(51) Int. Cl.
*H01F 27/24* (2006.01)
*H01F 41/02* (2006.01)
*H01F 27/32* (2006.01)

(52) U.S. Cl.
CPC ..... *H01F 27/24* (2013.01); *H01F 27/325* (2013.01); *H01F 41/0206* (2013.01)

(58) Field of Classification Search
CPC ..... H01F 5/02; H01F 2005/046; H01F 27/24; H01F 27/26; H01F 27/30; H01F 27/306; H01F 27/325; H01F 17/0033; H01F 17/04
USPC ..... 336/185, 196, 198, 199, 208, 212, 214, 336/215, 221, 222
See application file for complete search history.

(56) References Cited

U.S. PATENT DOCUMENTS 2,404,254 A * 7/1946 Short ..... H01F 38/10 307/33
3,328,738 A * 6/1967 Broverman ..... H01F 30/14 336/215
3,373,347 A * 3/1968 Maka ..... H01F 29/146 323/250

(Continued)

FOREIGN PATENT DOCUMENTS

EP 2088603 A2 * 8/2009 ..... H01F 3/14
JP 2005051995 A * 2/2005
JP 2013020995 A * 1/2013

*Primary Examiner* — Tszfung J Chan
(74) *Attorney, Agent, or Firm* — Patterson Intellectual Property Law, P.C.; Gary L. Montle; Jerry Turner Sewell

(57) ABSTRACT

A magnetic connector assembly has three independent magnetic components sharing a common core structure. The magnetic assembly includes first, second, and third bobbins, and includes a magnetic core. The first bobbin includes at least one latch mechanism of a first type. The second bobbin includes at least one latch mechanism of the first type. The third bobbin includes at least one latch mechanism of a second type configured to engage the latch mechanisms of the first and second bobbins. The magnetic core includes first and second core halves, each including a main core body, a first outer leg, a second outer leg, a middle leg, a first intermediate leg, and a second intermediate leg. The first outer leg fits within a passageway of the first bobbin. The second outer leg fits within a passageway of the second bobbin. The middle leg fits within a passageway of the third bobbin.

9 Claims, 18 Drawing Sheets

(56) References Cited

U.S. PATENT DOCUMENTS

| | | | | |
|---|---|---|---|---|
| 5,506,559 | A * | 4/1996 | Yamaguchi | H01F 17/04 336/83 |
| 2004/0130426 | A1* | 7/2004 | Suzuki | H01F 30/04 336/212 |
| 2005/0047175 | A1* | 3/2005 | Kawasaki | H02M 3/33592 363/16 |
| 2010/0067263 | A1* | 3/2010 | Qian | H02M 3/285 363/21.12 |
| 2013/0121043 | A1* | 5/2013 | Pietkiewicz | H01F 30/12 363/40 |
| 2018/0323720 | A1* | 11/2018 | Njiende | H01F 3/14 |

* cited by examiner

SINGLE MAGNETIC ASSEMBLY COMBINING THREE INDEPENDENT MAGNETICS USING A MODIFIED "E" CORE WITH FOUR WINDING WINDOWS

CROSS-REFERENCE TO RELATED APPLICATION

This application claims benefit of the following patent application(s) which is/are hereby incorporated by reference: U.S. Provisional Application No. 62/528,742 filed Jul. 5, 2017, entitled "Single Magnetic Assembly Combining Three Independent Magnetics Using a Modified "E" Core with Four Winding Windows."

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

FIELD OF THE INVENTION

The present disclosure relates generally to transformers and methods for making transformers. More particularly, the present disclosure relates to magnetic assemblies having multiple independent magnetic components.

BACKGROUND OF THE INVENTION

In a conventional electronic system that includes magnetic components, each magnetic component comprises a respective core, a respective bobbin and a respective winding positioned on the bobbin. For example, FIGS. 1A and 1B illustrate a portion of a conventional printed circuit board 100 having a first magnetic assembly 110, a second magnetic assembly 112, and a third magnetic assembly 114. Each magnetic assembly may be a transformer, a choke (or inductor) or another type of magnetic component having a winding and a core.

The first magnetic assembly 110 comprises a bobbin 120A having a first pin rail 122A and a second pin rail 124A. Each pin rail supports a plurality of terminal pins 126A. At least two of the terminal pins are electrically connected to a winding 130A, which is wound about a passageway 132A having a first end 134A and a second end 136A. The first end of the passageway receives a middle leg 142A of a first core half 140A. A first outer leg 144A of the first core half extends along a first side of the bobbin in parallel with the passageway. A second outer leg 146A extends along a second side of the bobbin in parallel with the passageway. The second end of the passageway receives a middle leg 152A of a second core half 150A. Respective ends (not shown) of the first middle legs of the first and second core halves are adjacent within the passageway. In certain embodiments, the ends are spaced apart by a selected distance to provide an air gap in the magnetic path formed by the two middle legs. A first outer leg 154A of the second core half extends along the first side of the bobbin in parallel with the passageway. A second outer leg 156A extends along the second side of the bobbin in parallel with the passageway. In the illustrated embodiment, the respective ends of the corresponding outer legs along the sides of bobbin abut to form a continuous magnetic path from the middle legs and around the outside of the bobbin.

The second magnetic assembly 112 comprises a bobbin 1208 having a first pin rail 122B and a second pin rail 124B.

Each pin rail supports a plurality of terminal pins 1268. At least two of the terminal pins are electrically connected to a winding 1308, which is wound about a passageway 132B having a first end 134B and a second end 136B. The first end of the passageway receives a middle leg 142B of a first core half 140B. A first outer leg 144B of the first core half extends along a first side of the bobbin in parallel with the passageway. A second outer leg 1468 extends along a second side of the bobbin in parallel with the passageway. The second end of the passageway receives a middle leg 1528 of a second core half 1508. Respective ends (not shown) of the first middle legs of the first and second core halves are adjacent within the passageway. In certain embodiments, the ends are spaced apart by a selected distance to provide an air gap in the magnetic path formed by the two middle legs. A first outer leg 1548 of the second core half extends along the first side of the bobbin in parallel with the passageway. A second outer leg 156B extends along the second side of the bobbin in parallel with the passageway. In the illustrated embodiment, the respective ends of the corresponding outer legs along the sides of bobbin abut to form a continuous magnetic path from the middle legs and around the outside of the bobbin.

The third magnetic assembly 112 comprises a bobbin 120C having a first pin rail 122C and a second pin rail 124C. Each pin rail supports a plurality of terminal pins 126C. At least two of the terminal pins are electrically connected to a winding 130C, which is wound about a passageway 132C having a first end 134C and a second end 136C. The first end of the passageway receives a middle leg 142C of a first core half 140C. A first outer leg 144C of the first core half extends along a first side of the bobbin in parallel with the passageway. A second outer leg 146C extends along a second side of the bobbin in parallel with the passageway. The second end of the passageway receives a middle leg 152C of a second core half 150C. Respective ends (not shown) of the first middle legs of the first and second core halves are adjacent within the passageway. In certain embodiments, the ends are spaced apart by a selected distance to provide an air gap in the magnetic path formed by the two middle legs. A first outer leg 154C of the second core half extends along the first side of the bobbin in parallel with the passageway. A second outer leg 156C extends along the second side of the bobbin in parallel with the passageway. In the illustrated embodiment, the respective ends of the corresponding outer legs along the sides of bobbin abut to form a continuous magnetic path from the middle legs and around the outside of the bobbin.

As shown in FIGS. 1A and 1B, each of the first magnetic assembly 110, the second magnetic assembly 112 and the third magnetic assembly 114 occupies a respective area on an upper surface 160 of the printed circuit board 100. In addition to the minimum area required to accommodate the nominal peripheral dimensions of the respective magnetic assembly, additional space must be provided between each adjacent magnetic assembly to provide allowance for tolerances in the peripheral dimensions. Furthermore, in order to allow the magnetic assemblies to be automatically positioned on the printed circuit board (e.g., by using pick-and-place equipment), sufficient space must be provided between adjacent magnetic assemblies to allow the positioning equipment to engage the sides of the assemblies.

SUMMARY OF THE INVENTION

Accordingly, a need exists for a magnetic assembly that combines multiple magnetic components into a single component that can be positioned within a smaller surface area on a printed circuit board than the area occupied by the multiple magnetic components.

One aspect of the embodiments disclosed herein is a magnetic assembly having three independent magnetic components sharing a common core structure. The magnetic assembly includes first, second, and third bobbins, and includes a magnetic core. The first bobbin includes at least one latch mechanism of a first type. The second bobbin includes at least one latch mechanism of the first type. The third bobbin includes at least one latch mechanism of a second type configured to engage the latch mechanisms of the first and second bobbins. The magnetic core includes first and second core halves, each including a main core body, a first outer leg, a second outer leg, a middle leg, a first intermediate leg, and a second intermediate leg. The first outer leg fits within a passageway of the first bobbin. The second outer leg fits within a passageway of the second bobbin. The middle leg fits within a passageway of the third bobbin.

Another aspect of the embodiments disclosed herein is a magnetic core for simultaneous use with three independent magnetic bobbins. The magnetic core comprises a first core half and a second core half. Each of the first and second independent core halves includes a main core body, a first outer leg, a second outer leg, a middle leg, a first intermediate leg, and a second intermediate leg. The main core body extends in a first direction between a first end of the main core body and a second end of the main core body. The main core body has a main core outer surface, a first main core inner surface, a second main core inner surface, a third main core inner surface, and a fourth main core inner surface. The first, second, third, and fourth main core inner surfaces are positioned opposite the main core outer surface and face a second direction, which is perpendicular to the first direction.

The first outer leg extends perpendicularly from the main core body in the second direction. The first outer leg is positioned proximate to the first end of the main core body. The first outer leg has a first outer leg length which is defined between the first main core inner surface and a first outer leg end surface of the first outer leg. The first outer leg further has a first outer leg cross-sectional profile.

The second outer leg extends perpendicularly from the main core body in the second direction. The second outer leg is positioned proximate to the second end of the main core body. The second outer leg has a second outer leg length, which is defined between the fourth main core inner surface and a second outer leg end surface of the second outer leg. The second outer leg further has a second outer leg cross-sectional profile.

The middle leg extends perpendicularly from the main core body in the second direction. The middle leg is positioned between the first outer leg and the second outer leg. The middle leg has a middle leg length, which is defined between the second main core inner surface and a middle leg end surface of the middle leg. The middle leg length is also defined between the third main core inner surface and the middle leg end surface. The middle leg further has a middle leg cross-sectional profile.

The first intermediate leg extends perpendicularly from the main core body in the second direction. The first intermediate leg is positioned between the first outer leg and the middle leg. The first intermediate leg is spaced apart from the first outer leg by a first leg spacing and is spaced apart from the middle leg by a second leg spacing. The first intermediate leg has a first intermediate leg end surface which is positioned at least as far as the first outer leg end surface is positioned from the main core outer surface. The first intermediate leg end surface is also positioned at least as far as the second outer leg end surface is positioned from the main core outer surface. Likewise, the first intermediate leg end surface is also positioned at least as far as the middle leg end surface is positioned from the main core outer surface.

The second intermediate leg extends perpendicularly from the main core body in the second direction. The second intermediate leg is positioned between the middle leg and the second outer leg. The second intermediate leg is spaced apart from the middle leg by a third leg spacing and spaced apart from the second outer leg by a fourth leg spacing. The second intermediate leg has a second intermediate leg end surface which is aligned with the first intermediate leg end surface relative to the main core outer surface.

In certain embodiments, the first outer leg end surface of the first core half is spaced apart from the first outer leg end surface of the second core half by a first gap distance. The second outer leg end surface of the first core half may be spaced apart from the second outer leg end surface of the second core half by a second gap. The middle leg end surface of the first core half may be spaced apart from the middle leg end surface of the second core half by a third gap distance.

In certain embodiments, the first gap distance may be substantially equal to the second gap distance.

In certain embodiments, the second gap distance may be substantially equal to the third gap distance.

Another aspect of the embodiments disclosed herein is a magnetic assembly having three independent magnetic components sharing a common core structure. The magnetic assembly comprises a first bobbin, a second bobbin, a third bobbin, a first core half, and a second core half. The first bobbin has a first winding surrounding a respective passageway. The passageway has a first bobbin passageway profile. The first bobbin further has at least one latch mechanism of a first type. The second bobbin has a second winding surrounding a respective passageway. The passageway has a second bobbin passageway profile. The second bobbin further has at least one latch mechanism of the first type. The third bobbin has a third winding surrounding a respective passageway. The passageway has a third bobbin passageway profile. The third bobbin further has at least a first latch mechanism of a second type configured to engage the latch mechanism of the first type of the first bobbin and at least a second latch mechanism of the second type configured to engage the latch mechanism of the first type of the second bobbin.

Each of the first and second core halves includes a main core body, a first outer core leg, a second outer core leg, a middle leg, a first intermediate leg, and a second intermediate leg. The main core body extends in a first direction between a first end of the main core body and a second end of the main core body;

The first outer leg extends perpendicularly from the main core body in a second direction which is perpendicular to the first direction. The first outer leg is positioned proximate to the first end of the main core body. The first outer leg has a first outer leg cross-sectional profile configured to fit within the passageway of the first bobbin.

The second outer leg extends perpendicularly from the main core body in the second direction. The second outer leg is positioned proximate to the second end of the main core body. The second outer leg has a second outer leg cross-sectional profile configured to fit within the passageway of the second bobbin.

The middle leg extends perpendicularly from the main core body in the second direction. The middle leg is positioned between the first outer leg and the second outer leg. The middle leg has a middle leg cross-sectional profile configured to fit within the passageway of the third bobbin.

The first intermediate leg extends perpendicularly from the main core body in the second direction. The first intermediate leg is positioned between the first outer leg and the middle leg. The first intermediate leg is spaced apart from the first outer leg by a first leg spacing and is spaced apart from the middle leg by a second leg spacing. The first intermediate leg has a first intermediate leg cross-sectional profile and a respective end surface.

The second intermediate leg extends perpendicularly from the main core body in the second direction. The second intermediate leg is positioned between the middle leg and the second outer leg. The second intermediate leg is spaced apart from the middle leg by a third leg spacing and is spaced apart from the second outer leg by a fourth leg spacing. The second intermediate leg has a second intermediate leg cross-sectional profile and a respective end surface.

In certain embodiments, the first outer leg cross-sectional profile defines a first outer leg cross-sectional area. The second outer leg cross-sectional profile defines a second outer leg cross-sectional area. The middle leg cross-sectional profile defines a middle leg cross-sectional area. The first intermediate leg cross-sectional profile defines a first intermediate leg cross-sectional area. And the second intermediate leg cross-sectional profile defines a second intermediate leg cross-sectional area. The first intermediate leg cross-sectional area is at least as great as the sum of the first outer leg cross-sectional area and half of the middle leg cross-sectional area. The second intermediate leg cross-sectional area is at least as great as the sum of the second outer leg cross-sectional area and half of the middle leg cross-sectional area.

In certain embodiments, the first leg spacing may be substantially equal to the fourth leg spacing. The first outer leg cross-sectional area may be substantially equal to the second outer leg cross-sectional area. The first intermediate leg cross-sectional area may be substantially equal to the second intermediate leg cross-sectional area.

In certain embodiments, the first outer leg of each core half is configured to be inserted into the passageway of the first bobbin. The second outer leg of each core half is configured to be inserted into the passageway of the second bobbin. The middle leg of each core half is configured to be inserted into the passageway of the third bobbin. The first intermediate leg of each core half is configured to span between the first bobbin and the third bobbin with the respective end surface of the first intermediate leg of the first core half abutting the respective end surface of the first intermediate leg of the second core half. The second intermediate leg of each core half is configured to span between the second bobbin and the third bobbin with the respective end surface of the second intermediate leg of the first core half abutting the respective end surface of the second intermediate leg of the second core half.

In certain embodiments, the first bobbin includes a respective first end flange and a respective second end flange. The first and second end flanges are positioned at opposite ends of the passageway of the first bobbin. Each end flange of the first bobbin may include a first bobbin flange width, which is defined between the passageway and a lateral outer periphery of the respective end flange. The first bobbin flange width may be substantially equal to the first leg spacing. The second bobbin includes a respective first end flange and a respective second end flange. The first and second end flanges are positioned at opposite ends of the passageway of the second bobbin. Each end flange of the second bobbin may include a second bobbin flange width, which is defined between the passageway and a lateral outer periphery of the respective end flange. The second bobbin flange width may be substantially equal to the fourth leg spacing. The third bobbin includes a respective first end flange and a respective second end flange. The first and second end flanges are positioned at opposite ends of the passageway of the third bobbin. Each end flange of the third bobbin may include a third bobbin flange width, which is defined between the passageway and a lateral outer periphery of the respective end flange. The third bobbin flange width may be substantially equal to the second leg spacing and may further be substantially equal to the third leg spacing.

In certain embodiments, the first bobbin flange width is substantially equal to the third bobbin flange width.

In certain embodiments, the main core body has a selected common height.

In certain embodiments, the first outer legs and the first intermediate legs of the first and second core halves define a first winding window having a first winding window width determined by the first leg spacing. The first intermediate legs and the middle legs of the first and second core halves define a second winding window having a second winding window width determined by the second leg spacing. The middle legs and the second intermediate legs of the first and second core halves define a third winding window having a third winding window width determined by the third leg spacing. And the second intermediate legs and the second outer legs of the first and second core halves define a fourth winding window having a fourth winding window width determined by the fourth leg spacing.

In certain embodiments, the first leg spacing may be substantially equal to the fourth leg spacing.

In certain embodiments, the first bobbin has a respective first pin rail and a respective second pin rail. Each pin rail extends perpendicularly to the passageway of the first bobbin. Each pin rail has a respective latch mechanism of the first type at a respective first end. The second bobbin has a respective first pin rail and a respective second pin rail. Each pin rail extends perpendicularly to the passageway of the second bobbin. Each pin rail has a respective latch mechanism of the first type at a respective first end. The third bobbin has a respective first pin rail and a respective second pin rail. Each pin rail extends perpendicularly to the passageway of the third bobbin. Each pin rail has a respective latch mechanism of the second type at both a respective first end and a respective second end. Each latch mechanism of the second type may be configured to receive and engage a respective latch mechanism of the first type.

Another aspect of the embodiments disclosed herein is a method of assembling a magnetic assembly having three independent magnetic components sharing a common core structure. The method includes the step of engaging a latching mechanism of a first type on a first outer bobbin with a first latching mechanism of a second type on a middle bobbin to secure the first outer bobbin to the middle bobbin. The method further includes the step of engaging a latching mechanism of the first type on a second outer bobbin with a second latching mechanism of the second type on the middle bobbin to secure the second outer bobbin to the middle bobbin. The first outer bobbin, the second outer bobbin, and the middle bobbin has respective mutually parallel passageways. Each bobbin has a respective winding wound around the respective passageway. Each passageway further has a respective first end and a respective second end. The method further includes the step of engaging a first core half with the first outer bobbin, the second outer bobbin, and the middle bobbin by positioning a first outer leg of the first core half into the first end of the passageway of the first outer bobbin, positioning a first intermediate leg of the first core half between the first outer bobbin and the middle bobbin, positioning a middle leg of the first core half into the first end of the passageway of the middle bobbin, positioning a second intermediate leg of the first core half between the middle bobbin and the second outer bobbin, and positioning a second outer leg of the first core half into the first end of the second outer bobbin. The method further includes the step of engaging a second core half with the first outer bobbin, the second outer bobbin, and the middle bobbin by positioning a first outer leg of the second core half into the second end of the passageway of the first outer bobbin, positioning a first intermediate leg of the second core half between the first outer bobbin and the middle bobbin, positioning a middle leg of the second core half into the second end of the passageway of the middle bobbin, positioning a second intermediate leg of the second core half between the middle bobbin and the second outer bobbin, and positioning a second outer leg of the second core half into the second end of the passageway of the second outer bobbin.

In certain embodiments, the method further includes the step of selecting a first common length as a first length of the first intermediate leg of each of the first core half and the second core half. The combined first lengths of the first intermediate legs of the first core half and the second core half are at least as long as a passageway length of the passageway of the middle bobbin. The method further includes the step of selecting a second common length as a second length of the first intermediate leg of each of the first core half and the second core half. The combined second lengths of the first intermediate legs of the first core half and the second core half are at least as long as a passageway length of the passageway of the first outer bobbin.

In certain embodiments, the method further includes the step of selecting the first common length as a first length of the second intermediate leg of each of the first core half and the second core half. The combined first lengths of the second intermediate legs of the first core half and the second core half are at least as long as a passageway length of the passageway of the middle bobbin. The method further includes the step of selecting a third common length as a second length of the second intermediate leg of each of the first core half and the second core half. The combined second lengths of the second intermediate legs of the first core half and the second core half are at least as long as a passageway length of the passageway of the second outer bobbin.

In certain embodiments, the passageway length of the first outer bobbin is equal to the passageway length of the second outer bobbin.

In certain embodiments, the method further includes the step of selecting a fourth common length as a length of the middle leg of each of the first core half and the second core half. The fourth common length may be less than the first common length of each of the first and second intermediate legs. The middle legs of the combined first and second core halves have respective end surfaces, which are spaced apart to define a first gap positionable in the passageway of the middle bobbin.

In certain embodiments, the method further includes the step of selecting a fifth common length as a length of the first outer leg of each of the first core half and the second core half. The fifth common length may be less than the second common length. The first outer legs of the combined first and second core halves have respective end surfaces, which are spaced apart to define a second gap positionable in the passageway of the first outer bobbin.

In certain embodiments, the method further includes the step of selecting a sixth common length as a length of the second outer leg of each of the first core half and the second core half. The sixth common length may be less than the third common length. The second outer legs of the combined first and second core halves have respective end surfaces, which are spaced apart to define a third gap positionable in the passageway of the second outer bobbin.

In certain embodiments, the fifth common length is substantially equal to the sixth common length.

In certain embodiments, the method further includes the step of positioning the first outer bobbin, the second outer bobbin, and the middle bobbin on a printed circuit board.

BRIEF DESCRIPTIONS OF THE SEVERAL VIEWS OF THE DRAWINGS

Figure 3:
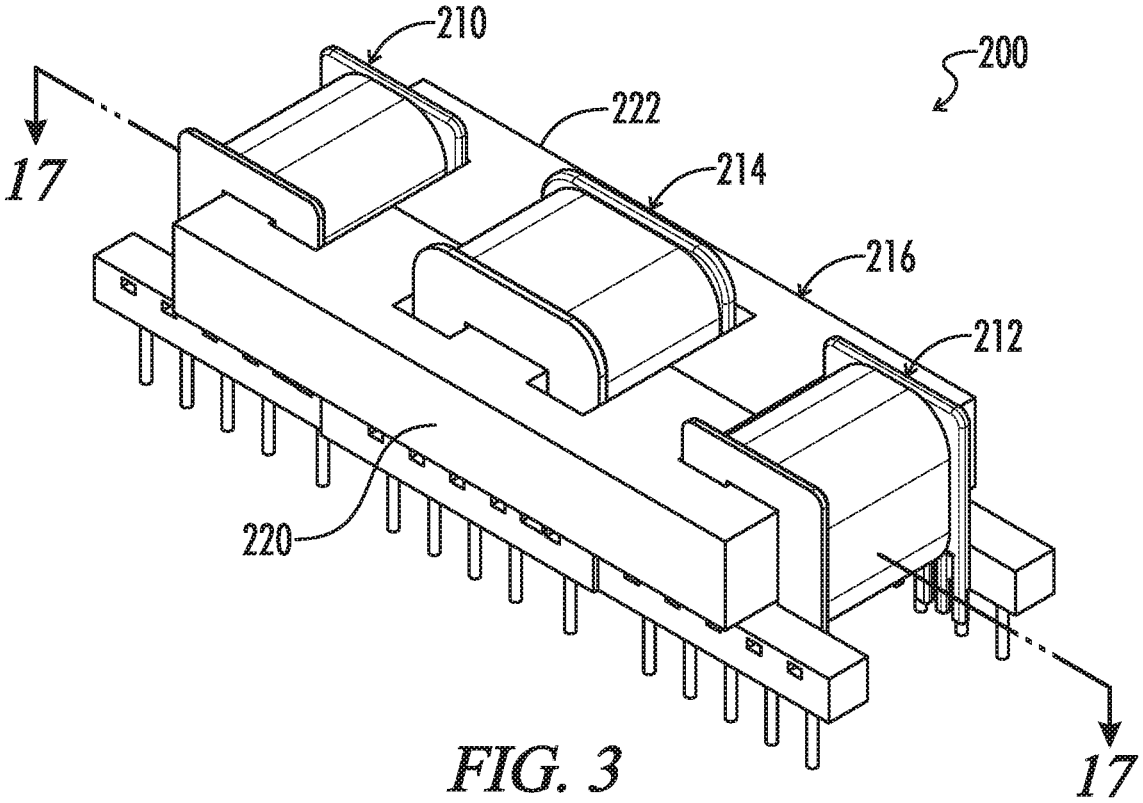
FIG. 3 illustrates an upper front perspective view of the single magnetic assembly of FIG. 2 prior to installation on the printed circuit.
Figure 4:
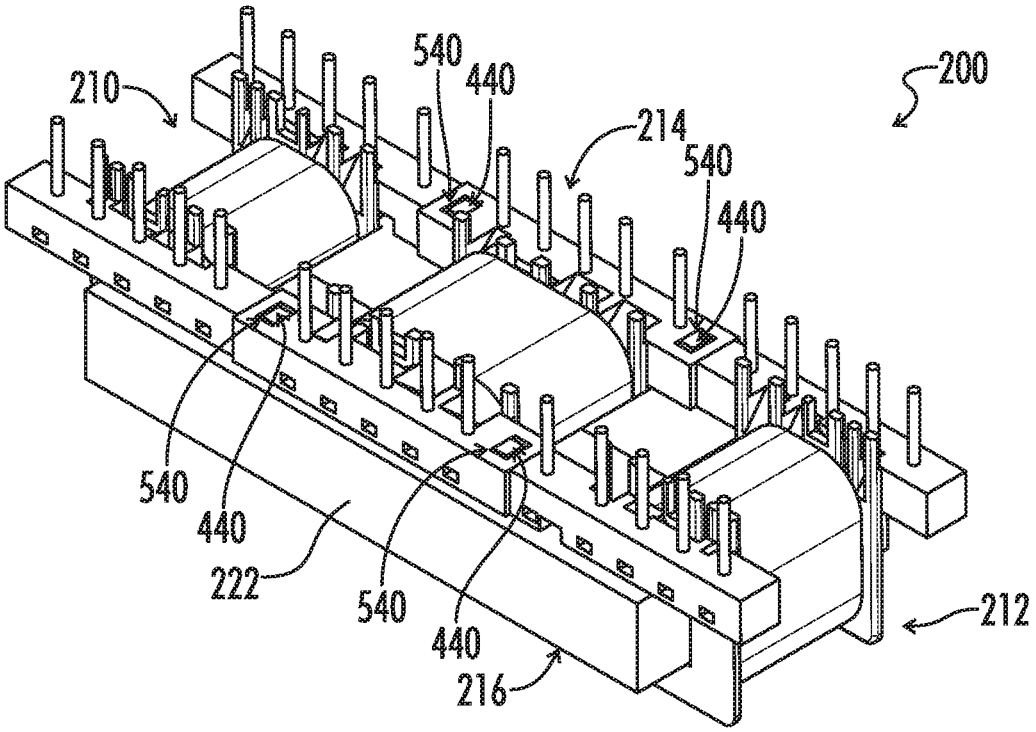
FIG. 4 illustrates a lower rear perspective view of the single magnetic assembly of FIG. 3.
Figure 5:
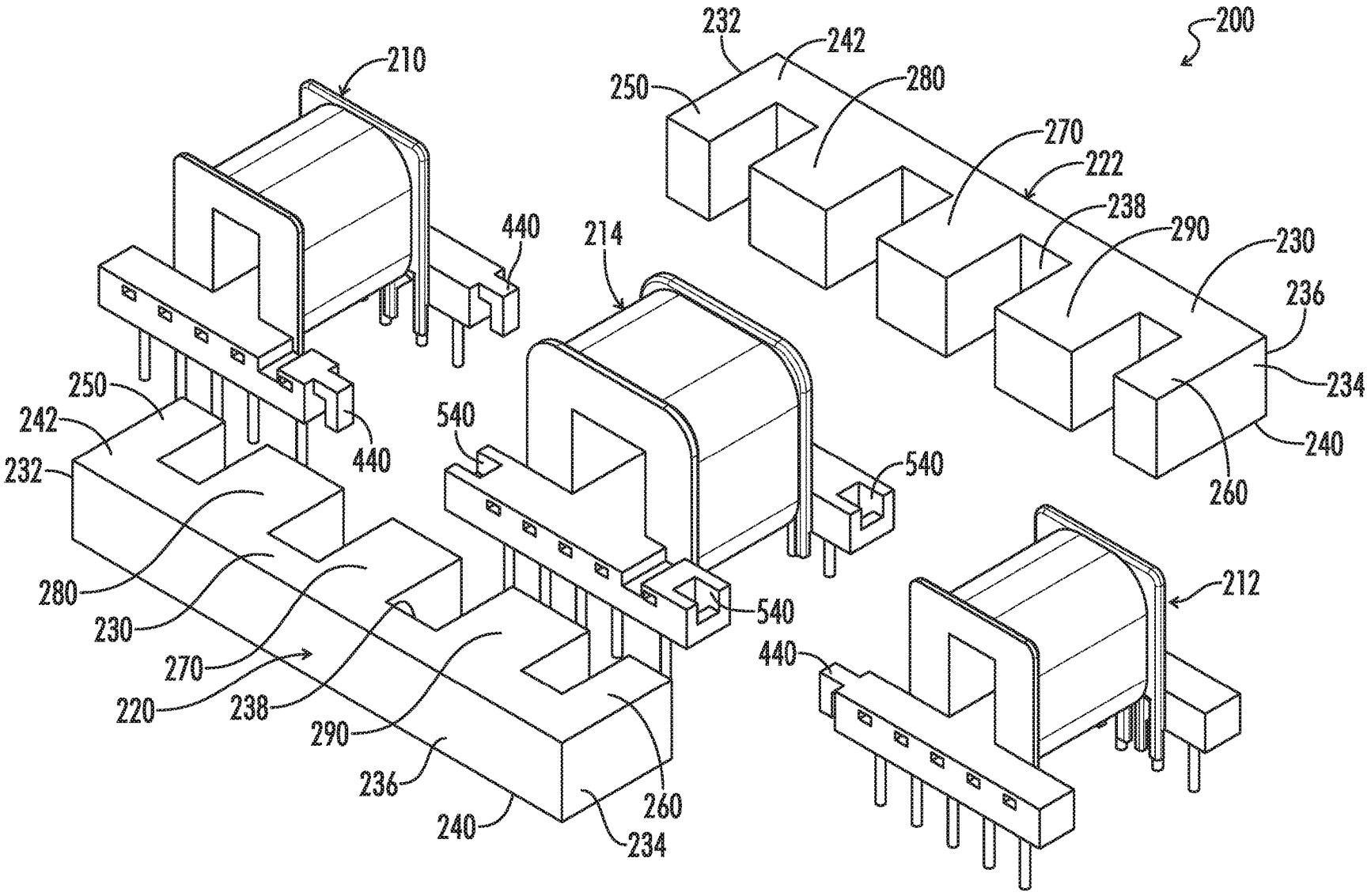
FIG. 5 illustrates an exploded upper front perspective view of the single magnetic assembly of FIG. 3.
Figure 17:
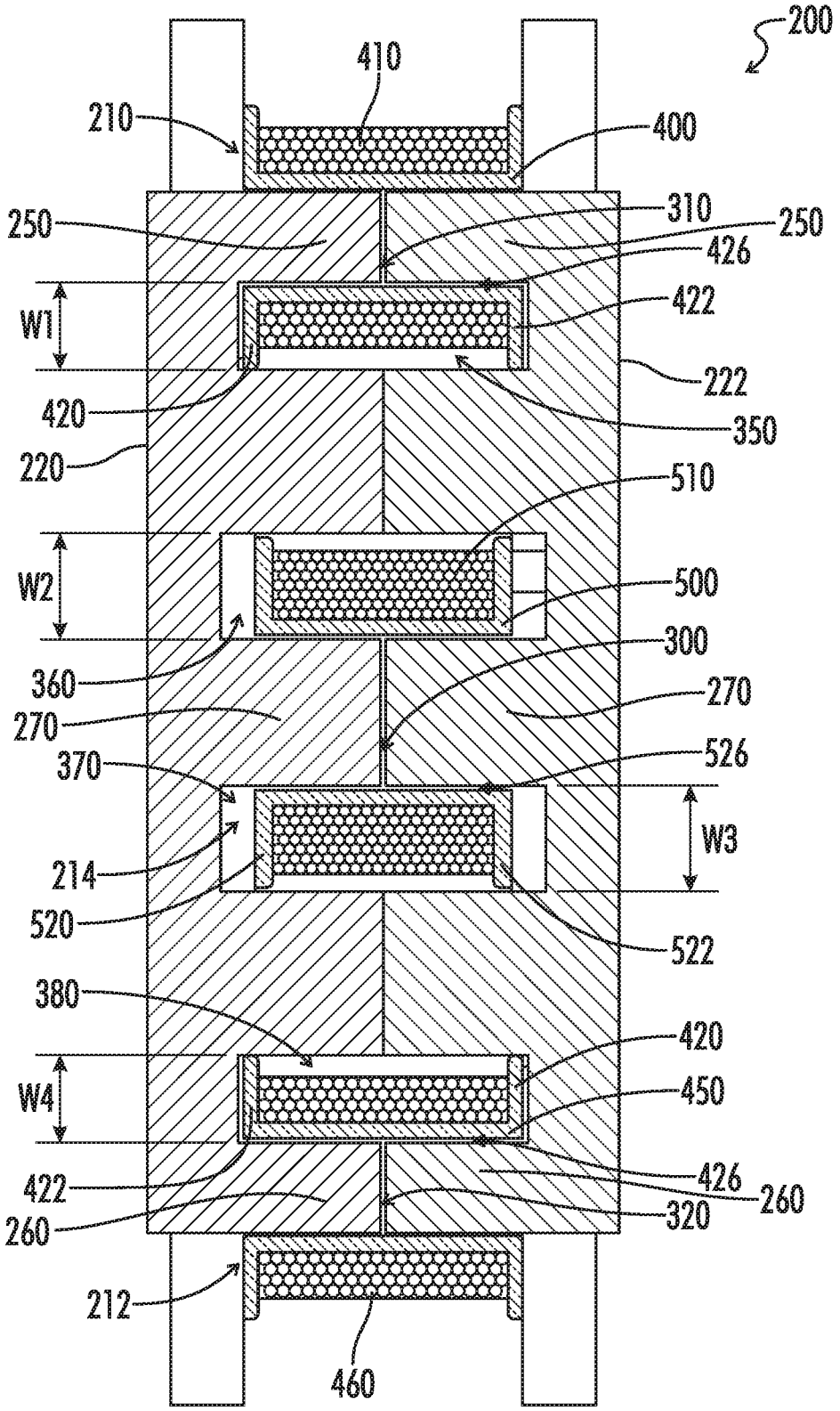

FIG. 17 illustrates a top plan cross-sectional view of the magnetic assembly of FIG. 3 taken along the line 17-17 of FIG. 3 showing the gaps between the ends of the middle legs of the core structure positioned within the passageway of the bobbin of the middle magnetic component and showing the gaps between the ends of the outer legs of the core structure positioned within the passageways of the bobbins of the leftmost and the rightmost magnetic components.

Figure 18:
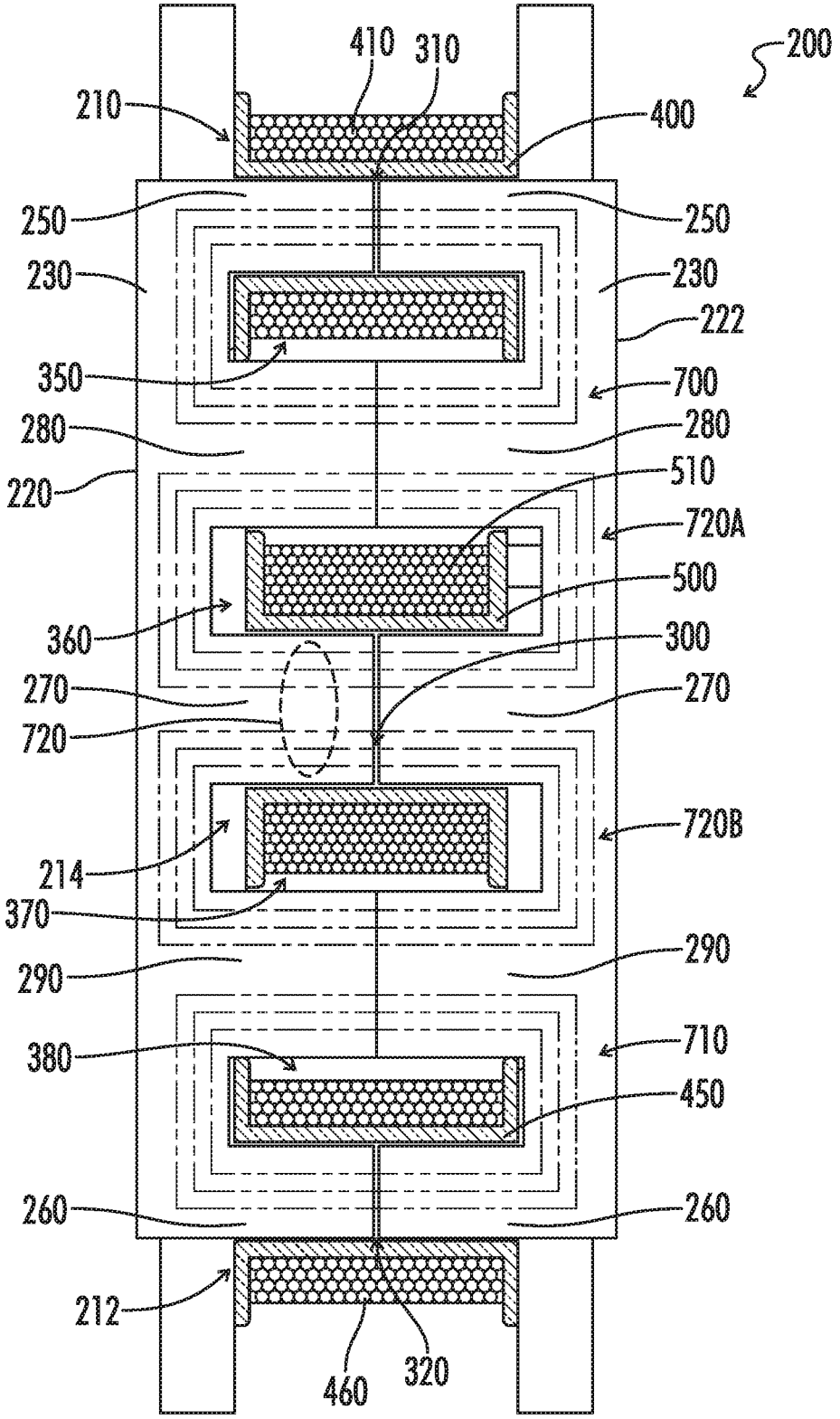

FIG. 18 pictorially illustrates the flux paths within the bodies and the legs of the two core halves of the core structure of the single magnetic assemblies caused by the three independent magnetic components.

Figure 1A:
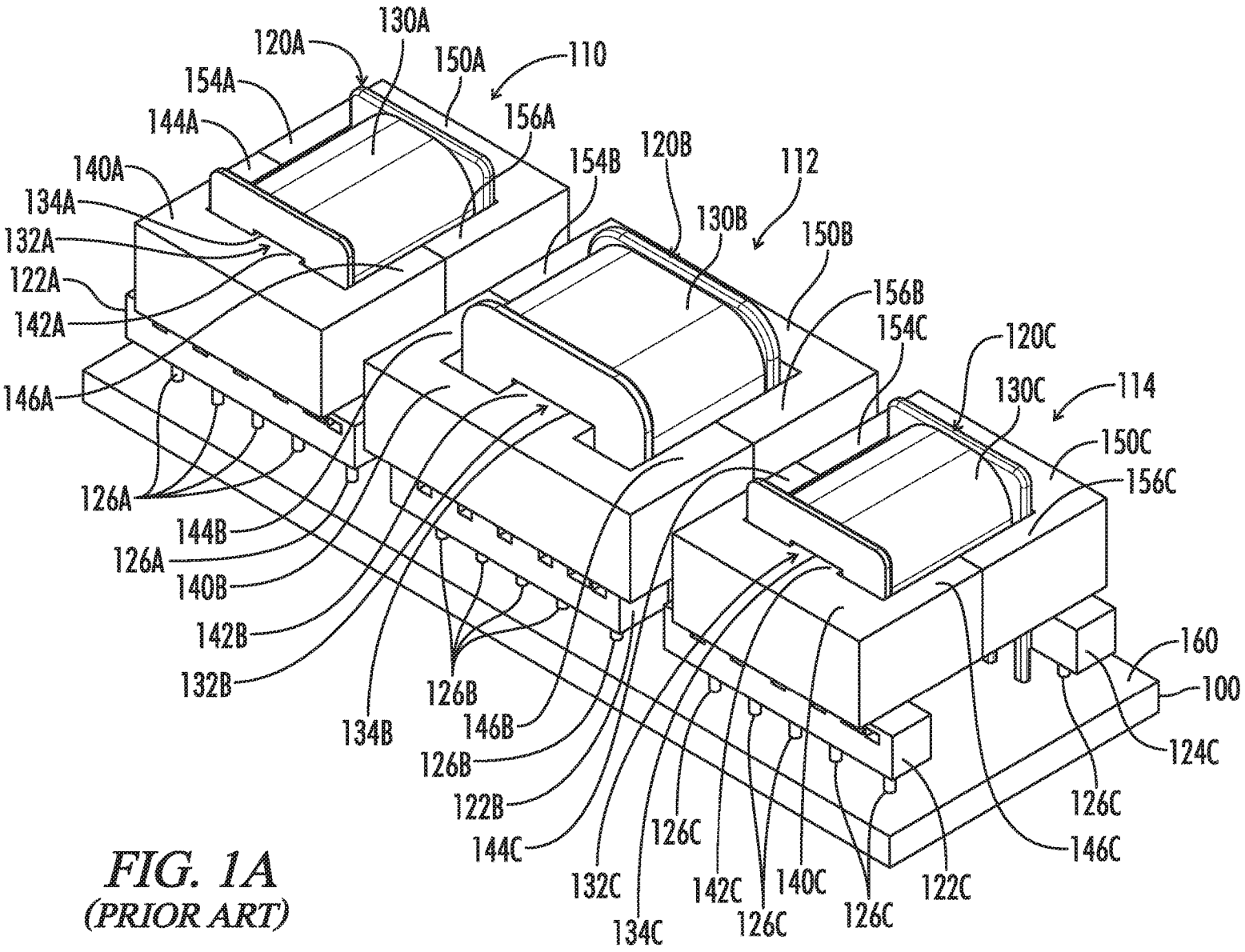
FIG. 1A (PRIOR ART)
FIG. 1A illustrates a front perspective view of a conventional printed circuit board with three independent magnetic assemblies positioned thereon.
Figure 1B:
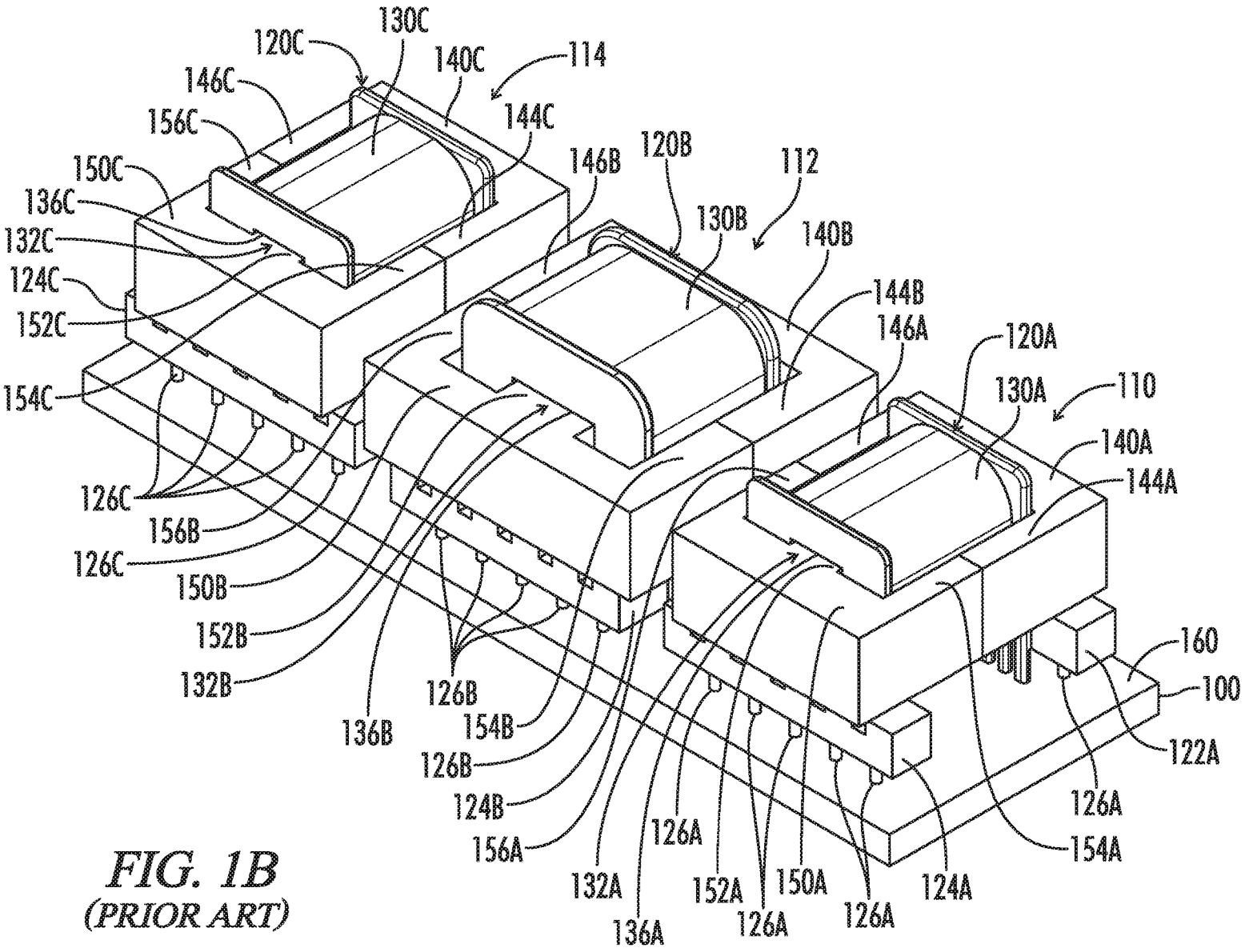
FIG. 1B (PRIOR ART)
FIG. 1B illustrates a rear perspective view of the printed circuit board and magnetic assemblies of FIG. 1A.
Figure 2:
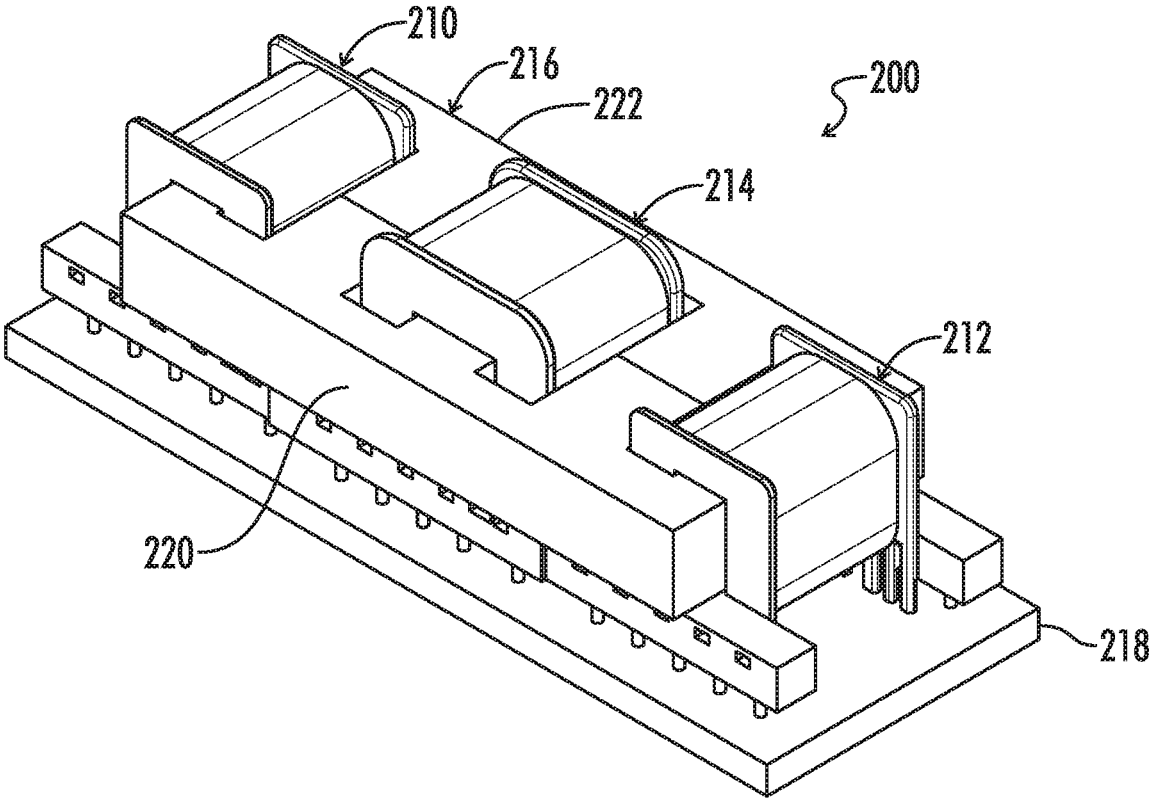
FIG. 2 illustrates an upper front perspective view of a single magnetic assembly mounted on a printed circuit board wherein the single magnetic assembly comprises three independent magnetic components sharing a common core structure.
Figure 19:
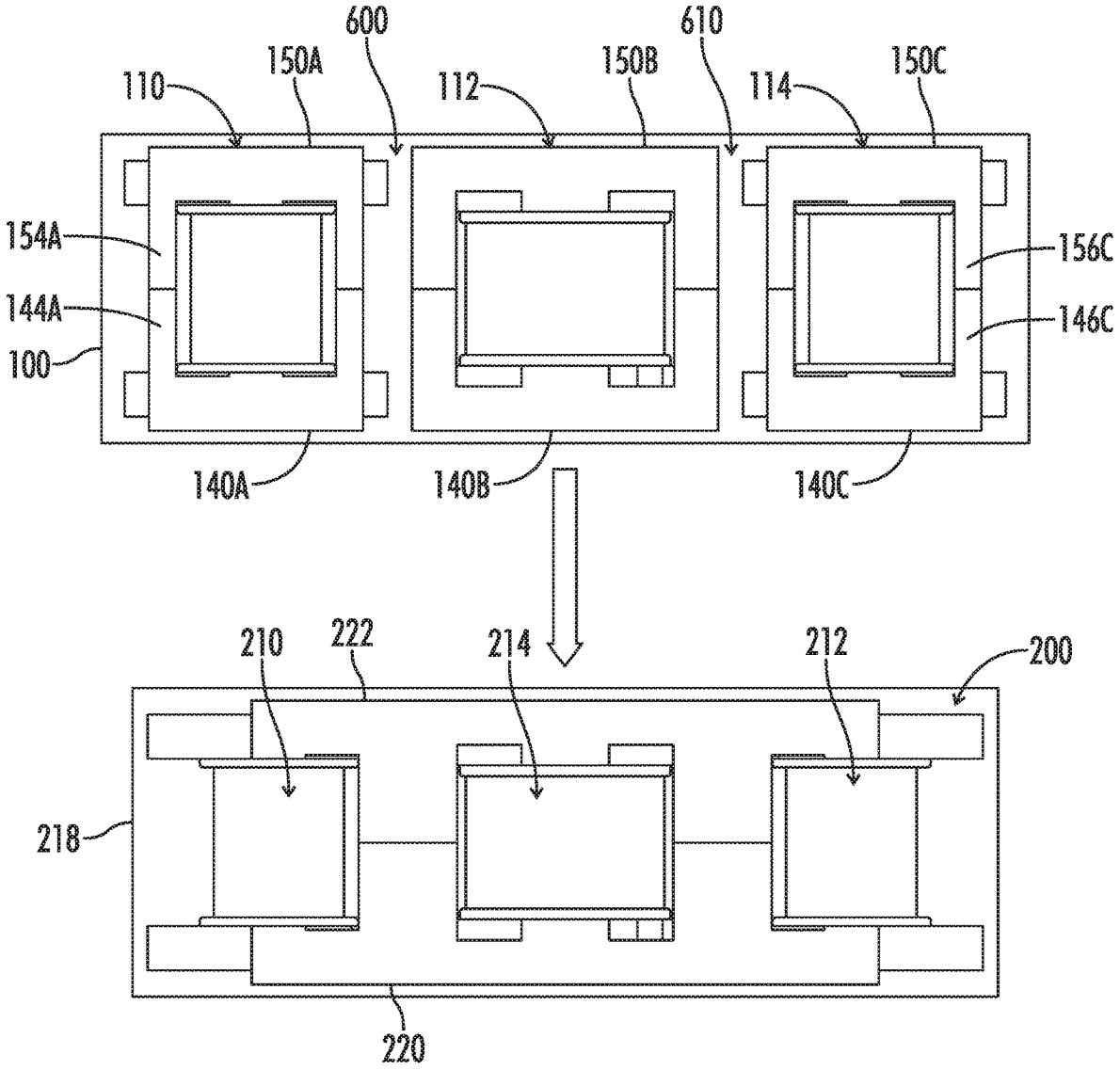

FIG. 19 pictorially compares the single magnetic assembly of FIG. 2 with the three separate magnetic assemblies of FIGS. 1A and 1B.

DETAILED DESCRIPTION OF THE INVENTION

In the following description, various dimensional and orientation words, such as height, width, length, longitudinal, horizontal, vertical, up, down, left, right, tall, low profile, and the like, may be used with respect to the illustrated drawings. Such words are used for ease of description with respect to the particular drawings and are not intended to limit the described embodiments to the orientations shown. It should be understood that the illustrated embodiments can be oriented at various angles and that the dimensional and orientation words should be considered relative to an implied base plane that would rotate with the embodiment to a revised selected orientation.

Reference will now be made in detail to embodiments of the present disclosure, one or more drawings of which are set forth herein. Each drawing is provided by way of explanation of the present disclosure and is not a limitation. It will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

It is intended that the present disclosure covers such modifications and variations as come within the scope of the appended claims and their equivalents. Other objects, features, and aspects of the present disclosure are disclosed in the following detailed description. It is to be understood by one of ordinary skill in the art that the present discussion is a description of exemplary embodiments only and is not intended as limiting the broader aspects of the present disclosure.

FIGS. 2-17 illustrate a single magnetic assembly 200 that includes a first (leftmost) magnetic component 210, a second (rightmost) magnetic component 212 and a third (middle) magnetic component 214 on a single core structure 216. The single magnetic assembly is mounted on a printed circuit board (PCB) 218 in FIG. 2. The magnetic assembly is shown prior to mounting on the PCB in FIGS. 3-17.

As shown in FIG. 3, for example, the magnetic assembly 200 comprises a first core half 220 and a second core half 222. In the illustrated embodiment, the first core half and the second core half are identical or are substantially identical and are positioned in the single magnetic assembly in a mirrored orientation. Each of the first core half and the second core half of the single core structure has a general appearance similar to a conventional E-core half; however, rather than having three core legs, each core half has five core legs as described below.

Figure 6:
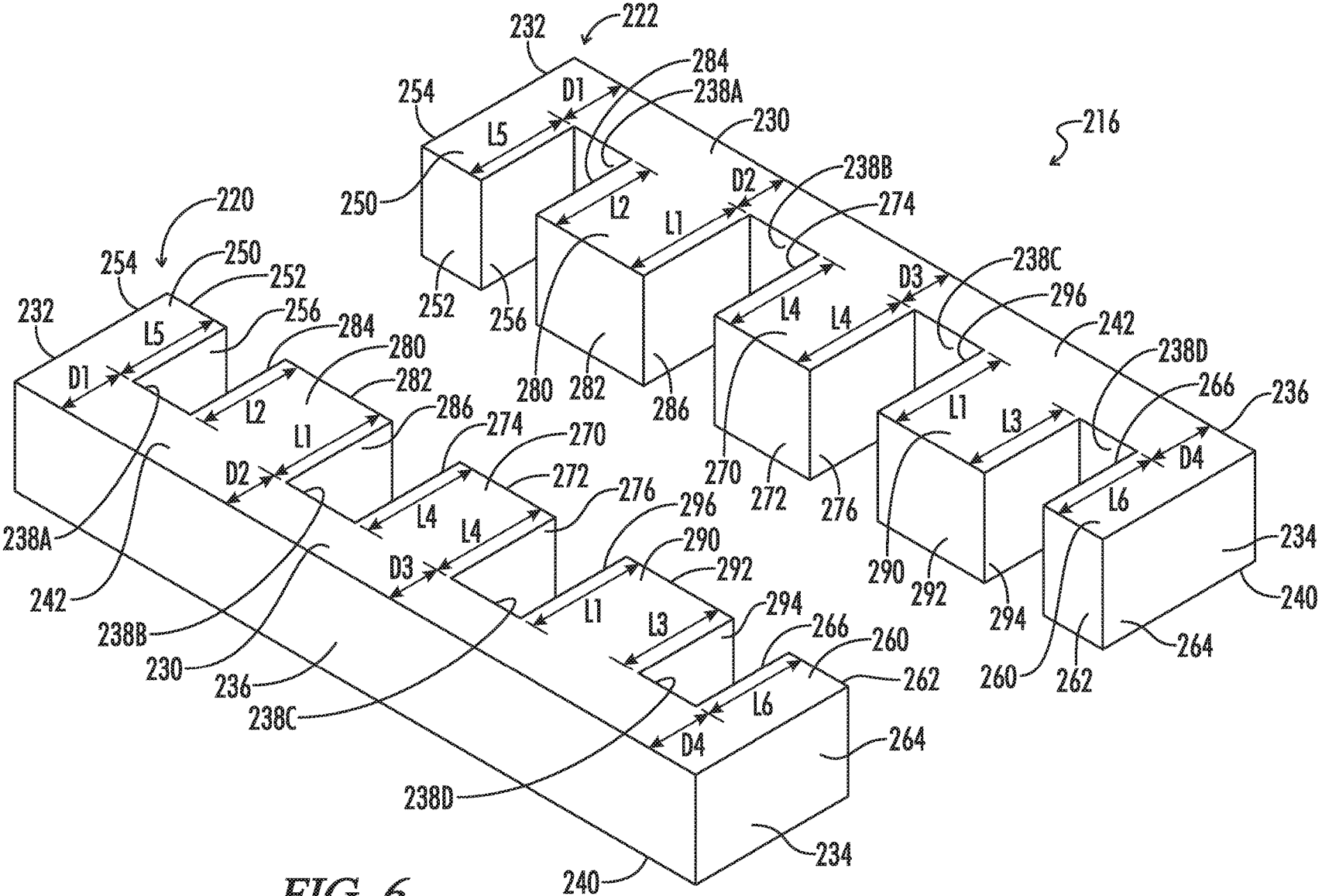
FIG. 6 illustrates upper front perspective views of the first core half and the second core half of the core structure of the magnetic assembly of FIG. 3.
Figure 7:
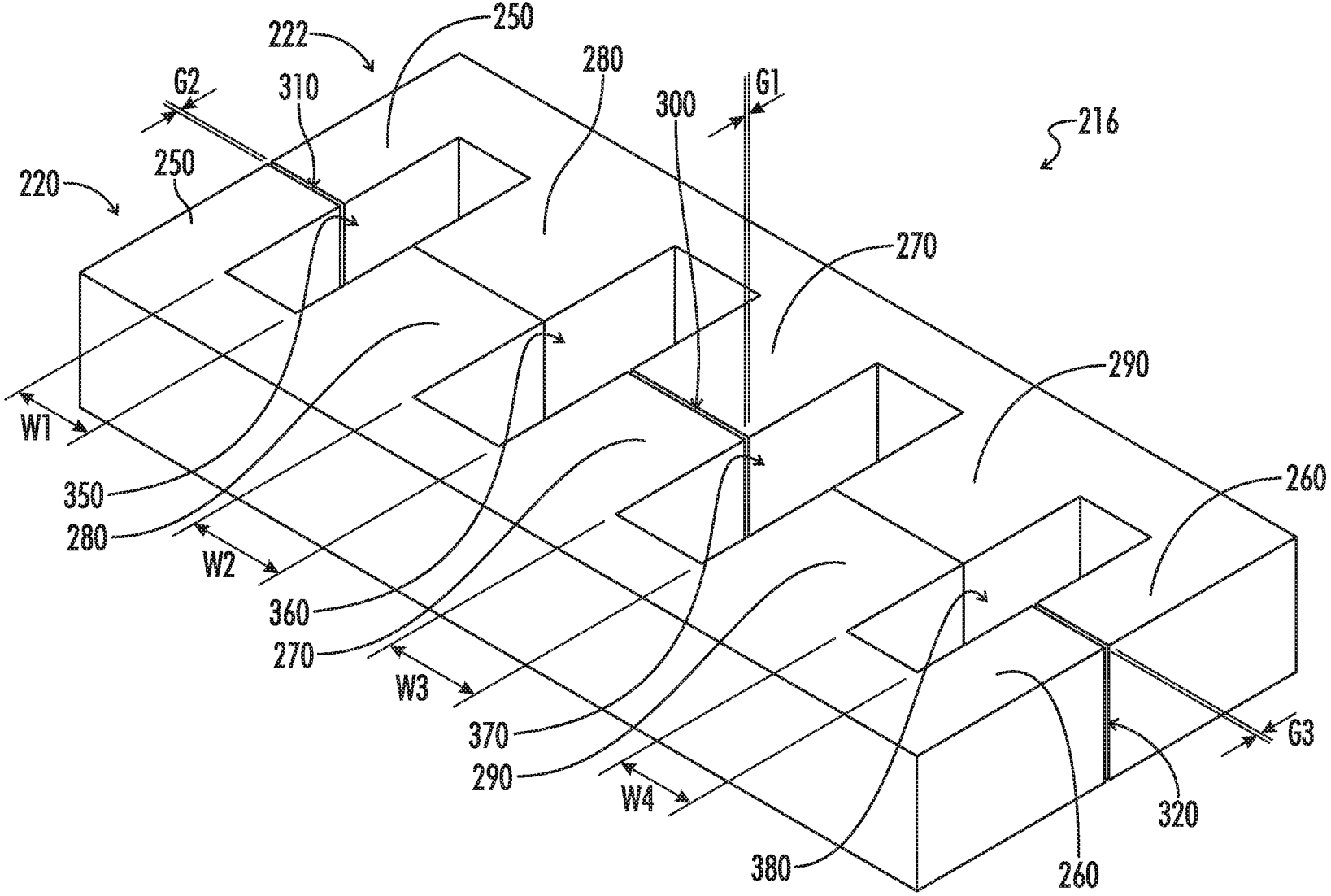
FIG. 7 illustrates an upper front perspective view of the first and second core halves juxtaposed to show the winding windows formed between the legs of the two core halves of the magnetic component of FIG. 3.
Figure 8:
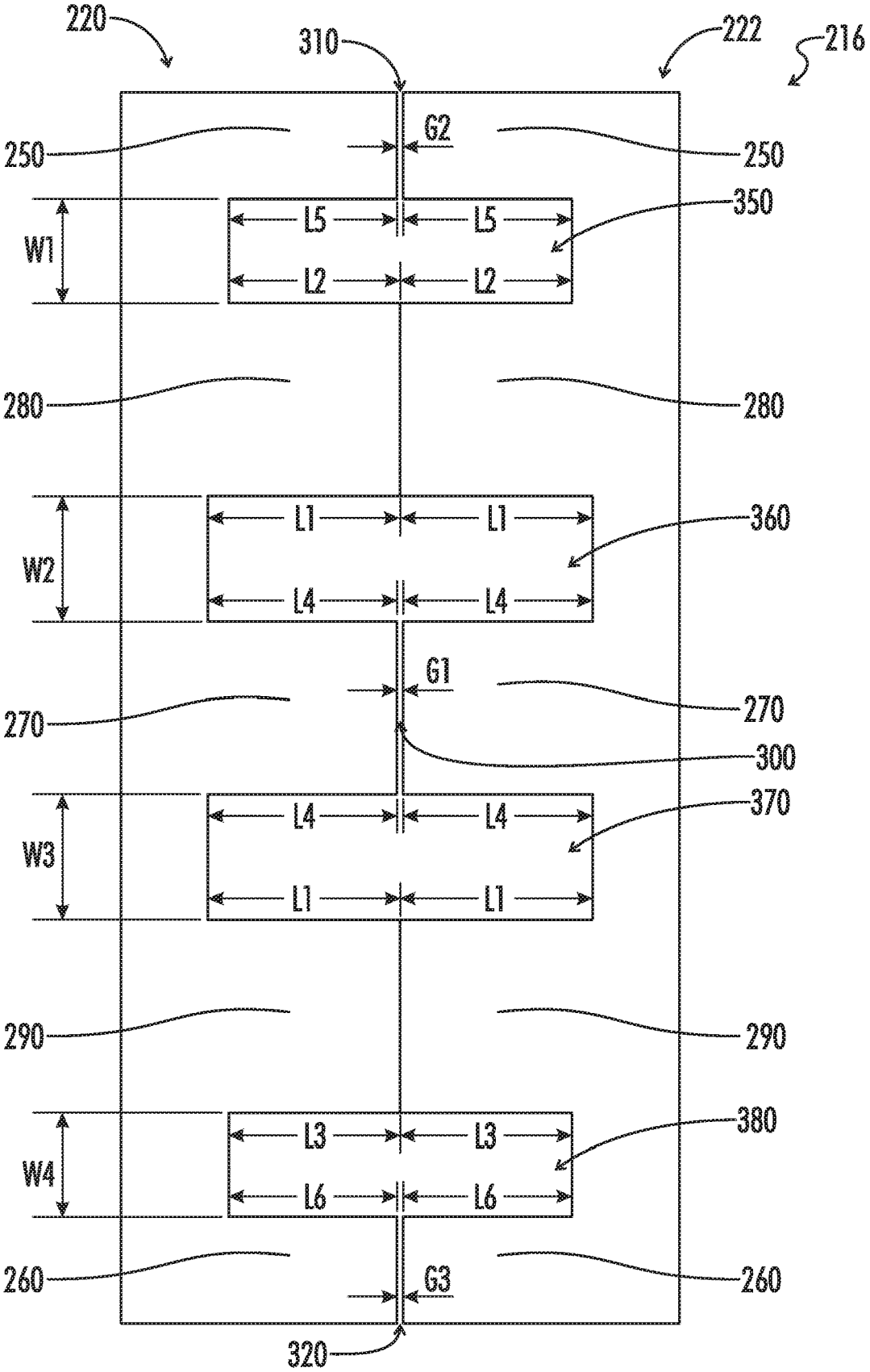
FIG. 8 illustrates a top plan view of the first and second core halves juxtaposed to show the common lengths of the legs of the two core halves of the magnetic component of FIG. 3.

As shown in FIG. 6, for example, the first core half 220 comprises a first core main half body portion 230 having a first end surface 232, a second end surface 234, an outer surface 236, an inner surface 238, a lower surface 240 and an upper surface 242. The inner surface 238 may be a single fixed distance from the outer surface 236. In the illustrated embodiment, the inner surface 238 is divided into first, second, third, and fourth inner surfaces 238A, 238B, 238C, 238D, respectively, as shown in FIGS. 6-8. The first inner surface 238A is spaced apart from the outer surface 236 by a first distance D1. The second inner surface 238B is spaced apart from the outer surface by a second distance D2. The third inner surface 238C is spaced apart from the outer surface by a third distance D3. The fourth inner surface 238D is spaced apart from the outer surface by a fourth distance D4. In the illustrated embodiment, the first and fourth distances D1, D4 are substantially equal, and the second and third distances D2, D3 are substantially equal.

A first outer leg 250 of the first core half 220 extends perpendicularly from the inner surface 238 of the main body portion 230 near the first end surface 232 of the main body portion. The first outer leg has a first outer leg end surface 252. The first outer leg has an outer surface 254 and an inner surface 256. In the illustrated embodiment, the outer surface of the first outer leg is coplanar with the first end surface 232 of the main body portion. The inner surface of the first outer leg is parallel to the outer surface of the first outer leg. In the illustrated embodiment, the first outer leg has a lower surface coplanar with the lower surface 240 of the main body portion and has an upper surface coplanar with the upper surface 242 of the main body portion. The common upper and lower surfaces of the first outer leg and the other legs described in the following paragraphs are not numbered separately.

A second outer leg 260 of the first core half 220 extends perpendicularly from the inner surface 238 of the main body portion 230 near the second end surface 234 of the main body portion. The second outer leg has a second outer leg end surface 262. The second outer leg has an outer surface 264 and an inner surface 266. In the illustrated embodiment, the outer surface of the second outer leg is coplanar with the second end surface 234 of the main body portion. The inner surface of the second outer leg is parallel to the outer surface of the second outer leg. In the illustrated embodiment, the second outer leg has a lower surface coplanar with the lower surface 240 of the main body portion and has an upper surface coplanar with the upper surface 242 of the main body portion.

A middle leg 270 of the first core half 220 extends perpendicularly from the inner surface 238 of the main body portion 230 approximately midway between the first end surface 232 and the second end surface 234 of the main body portion. The middle leg has a middle leg end surface 272. The middle outer leg has a first lateral surface 274 and a second lateral surface 276. The first lateral surface faces toward the first end surface of the main body portion. The second lateral surface faces toward the second end surface of the main body portion. The first lateral surface and the second lateral surface are parallel to each other and parallel to the first and second end surfaces of the main body portion.

In the illustrated embodiment, the middle leg has a lower surface coplanar with the lower surface 240 of the main body portion and has an upper surface coplanar with the upper surface 242 of the main body portion.

A first intermediate leg 280 of the first core half 220 extends perpendicularly from the inner surface 238 of the main body portion 230 at a location between the first outer leg 250 and the middle leg 270. In the illustrated embodiment, the first intermediate leg is positioned approximately midway between the first outer leg and the middle leg. The first intermediate leg has a first intermediate leg end surface 282. The first intermediate leg has a first lateral surface 284 and a second lateral surface 286. The first lateral surface of the first intermediate leg faces toward and is parallel to the inner surface 256 of the first outer leg. The second lateral surface faces toward and is parallel to the first lateral surface 274 of the middle leg. In the illustrated embodiment, the first intermediate leg has a lower surface coplanar with the lower surface 240 of the main body portion and has an upper surface coplanar with the upper surface 242 of the main body portion.

A second intermediate leg 290 of the first core half 220 extends perpendicularly from the inner surface 238 of the main body portion 230 at a location between the second outer leg 260 and the middle leg 270. In the illustrated embodiment, the second intermediate leg is positioned approximately midway between the second outer leg and the middle leg. The second intermediate leg has a second intermediate leg end surface 292. The second intermediate leg has a first lateral surface 294 and a second lateral surface 296. The first lateral surface of the second intermediate leg faces toward and is parallel to the inner surface 266 of the second outer leg. The second lateral surface faces toward and is parallel to the second lateral surface 276 of the middle leg. In the illustrated embodiment, the second intermediate leg has a lower surface coplanar with the lower surface 240 of the main body portion and has an upper surface coplanar with the upper surface 242 of the main body portion.

As further shown in FIG. 6, the second core half 222 is configured the same or substantially the same as the first core half 220; and the elements of the body portion and legs of the second core half are numbered the same as the corresponding elements of the first core half. In the illustrated embodiment, the first and second core halves are mirror images; and the end surface 252 of the first outer leg 250 of the first core half is juxtaposed with the end surface 252 of the first outer leg 250 of the second core half as shown.

When the two core halves 220, 222 of the core structure 216 are mated as shown in FIGS. 7-8, the respective end surfaces 252 of the first outer legs 250 of the two core halves are positioned adjacent to each other; the respective end surfaces 262 of the second outer legs 260 of the two core halves are positioned adjacent to each other; the respective end surfaces 272 of the middle legs 270 of the two core halves are positioned adjacent to each other; the respective end surfaces 282 of the first intermediate legs 280 of the two core halves are positioned adjacent to each other; and the respective end surfaces 292 of the second intermediate legs 290 of the two core halves are positioned adjacent to each other. As described below, the respective end surfaces of the respective intermediate legs are abutting. The respective end surfaces of the respective outer legs and middle legs are spaced apart.

In the illustrated embodiment, the first intermediate leg 280 of each core half 220, 222 and the second intermediate leg 290 of each core half have a first common selected length L1 (FIG. 8) such that when the two core halves are mated as shown in FIGS. 6-8, the respective end surfaces 282 of the first intermediate legs of the two core halves touch (e.g., abut) and the respective end surfaces 292 of the second intermediate legs of the two core halves touch (e.g., abut). The first common selected length L1 is defined along the second lateral surface 286 (FIG. 6) of the first intermediate leg 280 of each core half 220, 222 and measured between the second inner surface 238B of the main body portion 230 and the first intermediate leg end surface 282. The first common length L1 is likewise defined along the second lateral surface 296 (FIG. 6) of the second intermediate leg 290 of each core half and measured between the third inner surface 238C of the main body portion 230 and the second intermediate leg end surface 292. The second and third inner surfaces 238B, 238C may be equidistant from the outer surface 236.

The first intermediate legs 280 of the two core halves 220, 222 have a second common selected length L2 (FIG. 8) defined along the first lateral surface 284 and measured between the first inner surface 238A of the main body portion 230 and the first intermediate leg end surface 282.

The second intermediate legs 290 of the two core halves 220, 222 have a third common selected length L3 (FIG. 8) defined along the first later surface 294 and measured between the fourth inner surface 238D of the main body portion 230 and the second intermediate leg end surface 292. As discussed above, the first and fourth inner surfaces 238A, 238D may be uniformly spaced or variably spaced from the outer surface 236 of the main core body 230. In some embodiments (not shown), the first and fourth inner surfaces 238A, 238D may be aligned with the second and third inner surfaces 238B, 238C such that the first distance D1, the second distance D2, the third distance D3, and the fourth distance D4 are substantially equal.

In the illustrated embodiment, the middle legs 270 of the two core halves 220, 222 have a fourth common selected length L4 (FIG. 8) that is shorter than the first common selected length L1 such that when the two core halves are mated as shown in FIGS. 7-8, the respective end surfaces 272 of the middle legs are spaced apart from each other by a first gap 300 that is determined by the sum of the leg length differences. For example, if the first common selected length is L1 and the fourth common selected length is L4, a gap width G1 of the first gap 300 is calculated as $G1=2\times(L1-L4)$.

In the illustrated embodiment, the first outer legs 250 of the two core halves 220, 222 have a fifth common selected length L5 (FIG. 8) that is shorter than the second common selected length L2 such that when the two core halves are mated as shown in FIGS. 7-8, the respective end surfaces 252 of the first outer legs are spaced apart from each other by a second gap 310 that is determined by the sum of the leg length differences. For example, if the second common selected length is L2 and the fifth common selected length is L5, a gap width G2 of the second gap 310 is calculated as $G2=2\times(L2-L5)$.

In the illustrated embodiment, the second outer legs 260 of the two core halves 220, 222 have a sixth common selected length L6 (FIG. 8) that is shorter than the third common selected length L3 such that when the two core halves are mated as shown in FIGS. 7-8, the respective end surfaces 262 of the second outer legs are spaced apart from each other by a third gap 320 that is determined by the sum of the leg length differences. For example, if the third common selected length is L3 and the sixth common selected length is L6, a gap width G3 of the third gap 320 is calculated as $G3=2\times(L3-L6)$.

In the illustrated embodiment, the width G1 of the first gap 300, the width G2 of the second gap 310 and the width G3 of the third gap 320 are shown as being approximately the same width; however, the fourth, fifth and sixth common lengths may be selected such that one or more of the gap widths are different. For example, in one embodiment, the third and fourth common selected lengths of the first outer legs 250 and the second outer legs 260 are the same such that the second gap width G2 and the third gap width G3 may be the same. The second common selected length may be greater or smaller than the third and fourth common selected lengths such that the first gap width G1 differs from the second and third gap widths. In other embodiments, all three gap widths may differ from each other. It should be understood that the gap widths illustrated in the figures may be exaggerated so that the gaps may be visualized. In certain embodiments, the gap widths may be a small percentage of the lengths of the respective legs. For example, a gap may have a width of less than 0.001 inch or may have a width of more than 0.01 inch.

As further shown in FIG. 7, the juxtaposition of the end surfaces of the five legs forms four winding windows in the core structure 216. A first winding window 350 is formed between the juxtaposed first outer legs 250 and the juxtaposed first intermediate legs 280. The first winding window has a width W1 determined by the leg spacing between the respective inner surfaces 256 of the first outer legs and the respective first lateral surfaces 284 of the first intermediate legs. The first winding window has a respective length determined by two times the second common length L2.

A second winding window 360 is formed between the juxtaposed first intermediate legs 280 and the juxtaposed middle legs 270. The second winding window has a width W2 determined by the leg spacing between the respective second lateral surfaces 286 of the first intermediate legs and the respective first lateral surfaces 374 of the middle legs. The second winding window has a respective length determined by two times the first common length L1.

A third winding window 370 is formed between the juxtaposed second intermediate legs 290 and the juxtaposed middle legs 270. The third winding window has a width W3 determined by the leg spacing between the respective second lateral surfaces 296 of the second intermediate legs and the respective second lateral surfaces 276 of the middle legs. The third winding window has a respective length determined by two times the first common length L1.

A fourth winding window 380 is formed between the juxtaposed second outer legs 260 and the juxtaposed second intermediate legs 290. The fourth winding window has a width W4 determined by the leg spacing between the respective inner surfaces 266 of the second outer legs and the respective first lateral surfaces 294 of the second intermediate legs. The fourth winding window has a respective length determined by two times the third common length L3.

In the illustrated embodiment, the main body portion 230 of each core half 220, 222, has a width from the first end 232 to the second end 234 of approximately 2.027 inches. The main body portion and the five legs 250, 260, 270, 280, 290 extending from the main body portion have a common height from the lower surface 240 to the upper surface 242 of approximately 0.283 inch. Each of the first outer leg 250 and the second outer leg 260 has a width of approximately 0.176 inch. The middle leg 270 has a width of approximately 0.285 inch. Each of the first intermediate leg 280 and the second intermediate leg 290 has a width of approximately 0.275 inch. The width of the first intermediate leg is equal to at least the width of the first outer leg plus one-half of the width of the middle leg. The width of the second intermediate leg is equal to at least the width of the second outer leg plus one-half of the width of the middle leg.

The inner surface 256 of the first outer leg 250 and the first lateral surface 284 of the first intermediate leg 280 are spaced apart by a leg spacing of approximately 0.21 inch, which corresponds to the width W1 of the first winding window 350. The inner surface 266 of the second outer leg 260 and the first lateral surface 294 of the second intermediate leg 290 are also spaced apart by a leg spacing of approximately 0.21 inch, which corresponds to the width W4 of the fourth winding window 380. The first lateral surface 274 of the middle leg 270 is spaced apart from the second lateral surface 286 of the first intermediate leg by a leg spacing of approximately 0.21 inch, which corresponds to the width W2 of the second winding window 360. The second lateral surface 276 of the middle leg is spaced apart from the second lateral surface 296 of the second intermediate leg by a leg spacing of approximately 0.21 inch, which corresponds to the width W3 of the third winding window 370. In the illustrated embodiment, the winding window widths are the same or substantially the same; however, in other embodiments, the widths of one or more of the winding windows may differ from the widths of other winding windows.

Each of the core halves 220, 222 has a maximum length from the outer surface 236 of the main core body 230 to the end surfaces 282, 292 of each of the first and second intermediate legs 280, 290, respectively. In the illustrated embodiment, the maximum length is approximately 0.46 inch.

The main body portion 230 has a thickness from the outer surface 236 to the inner surface 238 that differs in accordance with the location. The main body portion has a thickness of approximately 0.177 inch in a first region between the inner surface 256 of the first outer leg 250 and the first lateral surface 284 of the first intermediate leg 280, which corresponds to the first winding window 350. The main body portion has a thickness of approximately 0.143 inch in a second region between the second lateral surface 286 of the first intermediate leg and the first lateral surface 274 of the middle leg 270, which corresponds to the second winding window 360. The main body portion has a thickness of approximately 0.143 inch in a third region between the second lateral surface 276 of the middle leg and the second lateral surface 296 of the second intermediate leg 290, which corresponds to the third winding window 370. The main body portion has a thickness in a fourth region between the first lateral surface 294 of the second intermediate leg and the inner surface 266 of the second outer leg 260, which corresponds to the fourth winding window 380.

When the first core half 220 and the second core half 222 are mated as illustrated in FIG. 7, the respective end surfaces 282 of the first intermediate legs 280 of the two core halves abut, and the respective end surfaces 292 of the second intermediate legs 290 of the core halves abut. In the illustrated embodiment, the first winding window 350 and the fourth winding window 380 have lengths of approximately 0.566 inch determined by twice the difference between the overall length of each core section (e.g., 0.46 inch in the illustrated embodiment) and the thickness of the main body portion 230 in the first and third regions as described above (e.g., 0.177 inch in the illustrated embodiment). In the illustrated embodiment, the second winding window 360 and the third winding window 370 have lengths of approximately 0.634 inch determined by twice the difference between the overall length of each core section (e.g., 0.46 inch in the illustrated embodiment) and the thickness of the main body portion 230 in the second and third regions as described above (e.g., 0.143 inch in the illustrated embodiment).

Figure 9:
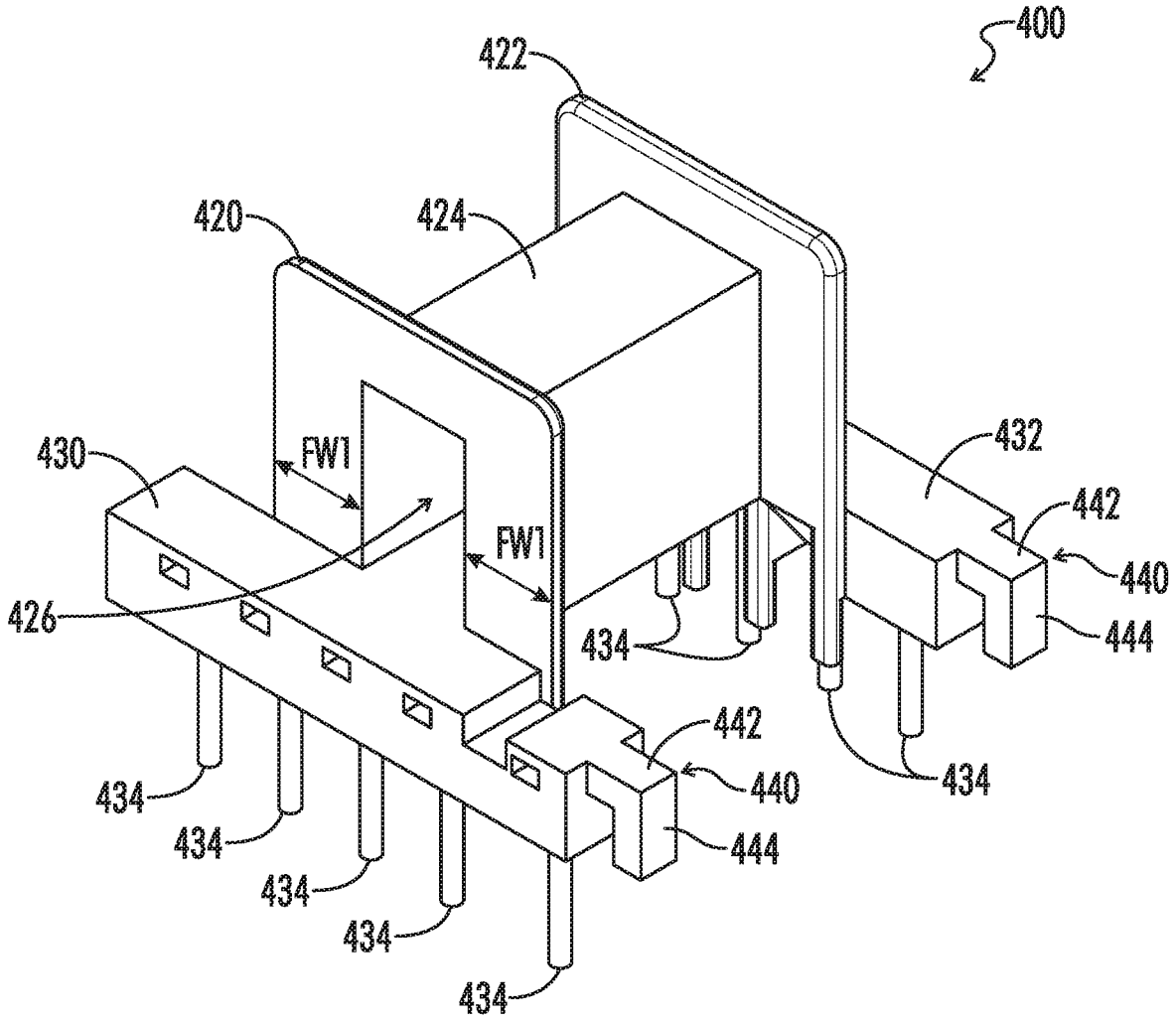
FIG. 9 illustrates an upper front perspective view of the bobbin of the leftmost magnetic component of FIG. 3.

As shown in FIG. 3, the first (leftmost) magnetic component 210 comprises a first bobbin 400 having a first winding 410. The first bobbin is shown in more detail in FIGS. 9 and 10. The first bobbin includes a first end flange 420 and a second end flange 422. A coil winding surface 424 extends between the first end flange and the second end flange. The coil winding surface surrounds a core leg receiving passageway 426. The outer surfaces of the first flange and the second flange of the first bobbin are spaced apart by a distance selected to be less than the length of the first winding window 350 of the mated core halves 220, 222 as shown in FIG. 9. Each flange has a width FW1 between the passageway and a lateral outer periphery of the flange that is selected to be no more than the width of the first winding window.

A first pin (or terminal) rail 430 extends from the first end flange 420. A second pin (or terminal) rail 432 extends from the second end flange 422. Each pin rail supports a plurality of pins (or terminals) 434. Selected ones of the pins are electrically connected to the first winding 410 by conductors (not shown) in a conventional manner.

Figure 15:
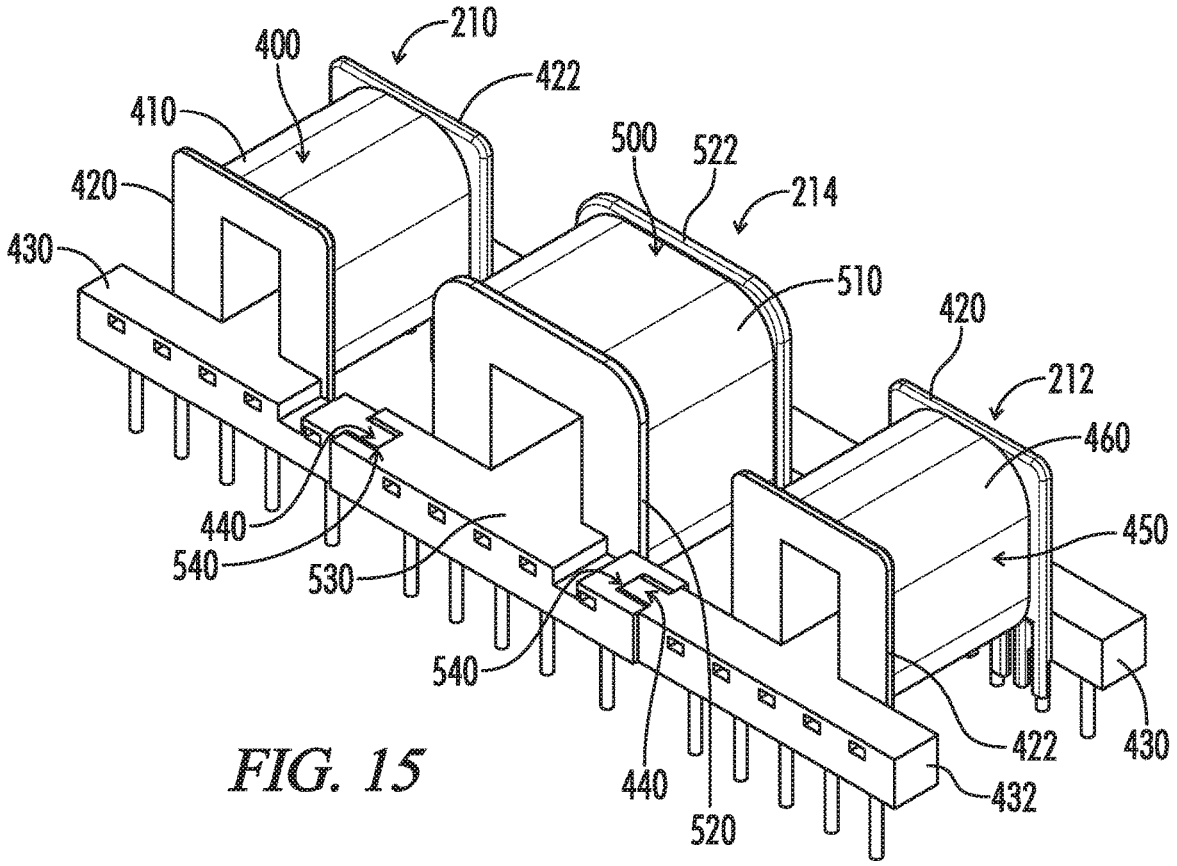
FIG. 15 illustrates an upper front perspective view the three bobbins of the three magnetic components interconnected prior to receiving the legs of the core structure.
Figure 16:
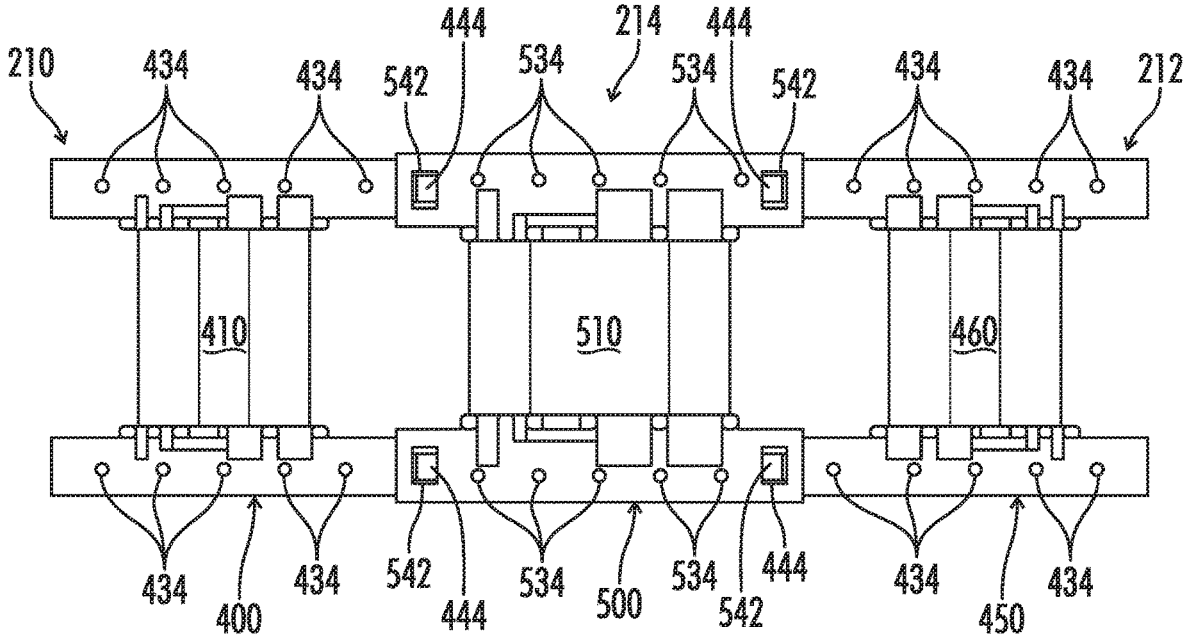
FIG. 16 illustrates a lower plan view of the interconnected bobbins of FIG. 15.

As shown, for example, in the cross-sectional view in FIG. 17, the passageway 426 of the first bobbin 400 has a shape and a size configured to receive the first outer legs 250 of the first and second core halves 220, 222 such that the second gap 310 formed by the juxtaposed end surfaces of the first outer legs is positioned approximately in the middle of the passageway between the first end flange 420 and the second end flange 422. When positioned as shown in FIG. 15 (facing the first end flange 420), the respective rightmost portions of the flanges and the rightmost portion of the winding 410 fit within the first winding window 350 (FIG. 17).

Figure 10:
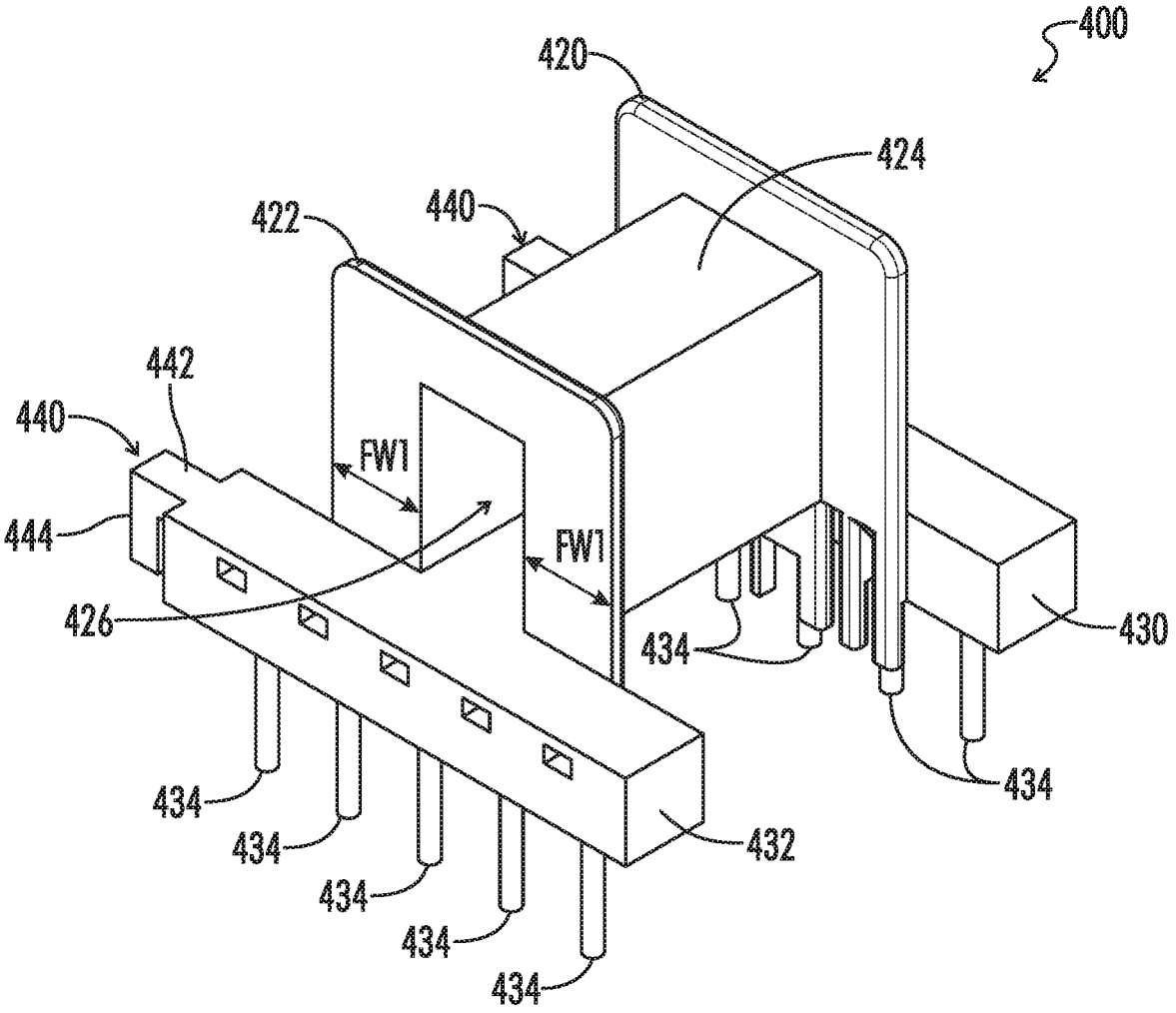
FIG. 10 illustrates an upper rear perspective view of the bobbin of the leftmost magnetic component of FIG. 3

As further shown in FIGS. 9 and 10, the first bobbin 400 further includes an engagement device 440 of a first type at a respective end of each of the first pin rail 430 and the second pin rail 432. In the view of FIG. 9 (facing the first end flange 420), the engagement device of the first type is positioned at the right end of each pin rail. In the illustrated embodiment, each engagement device of the first type comprises a hook that includes a first portion 442 that extends outward from the end of the pin rail and a second portion 444 that extends downward from the first portion. The length of the first portion is selected to cause the second portion to be offset from the end of the pin rail. In the illustrated embodiment, each of the first portion and the second portion has a square cross-sectional profile; however, the profile may be different in alternative embodiments.

Figure 11:
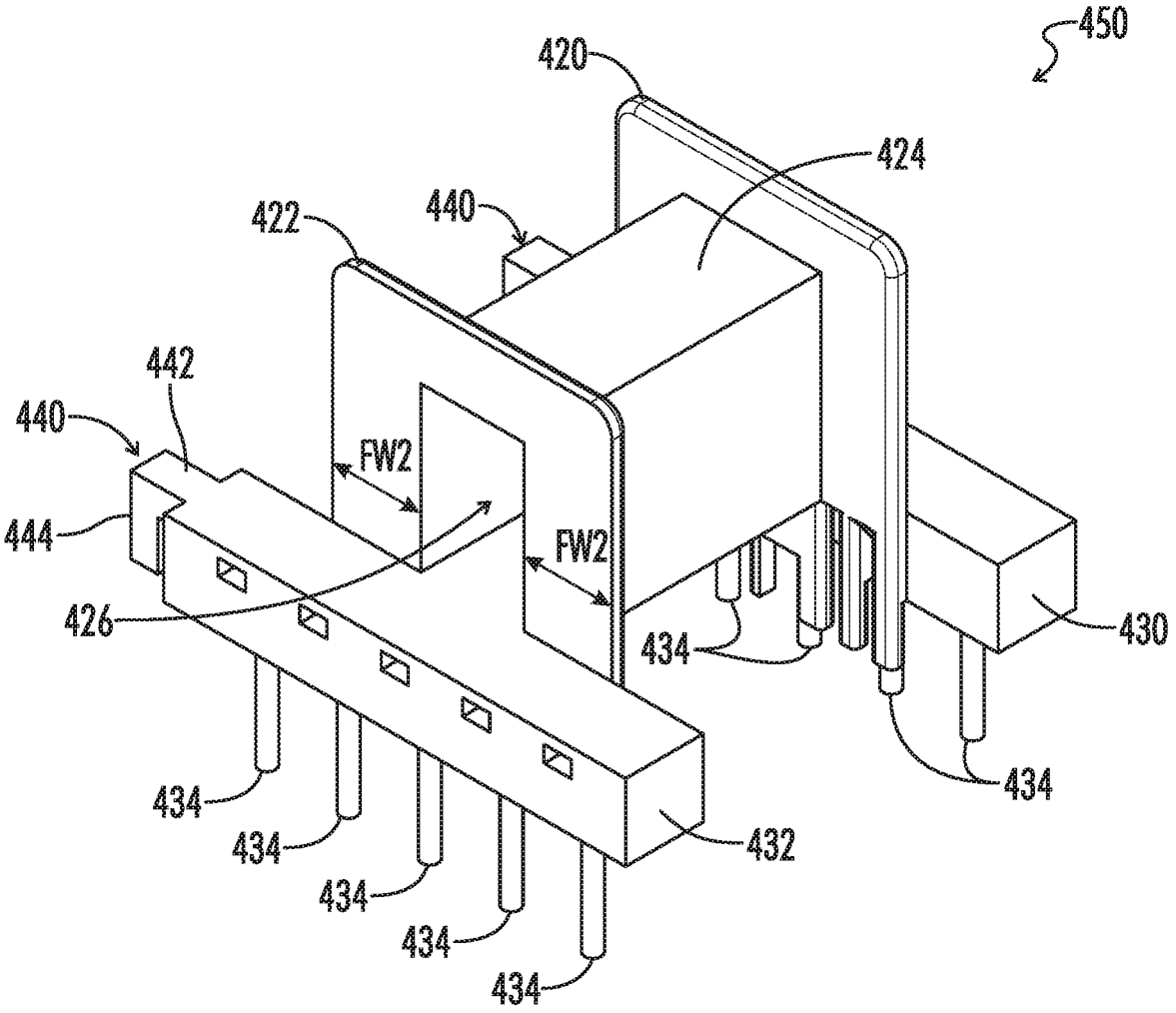
FIG. 11 illustrates an upper front perspective view of the bobbin of the rightmost magnetic component of FIG. 3.
Figure 12:
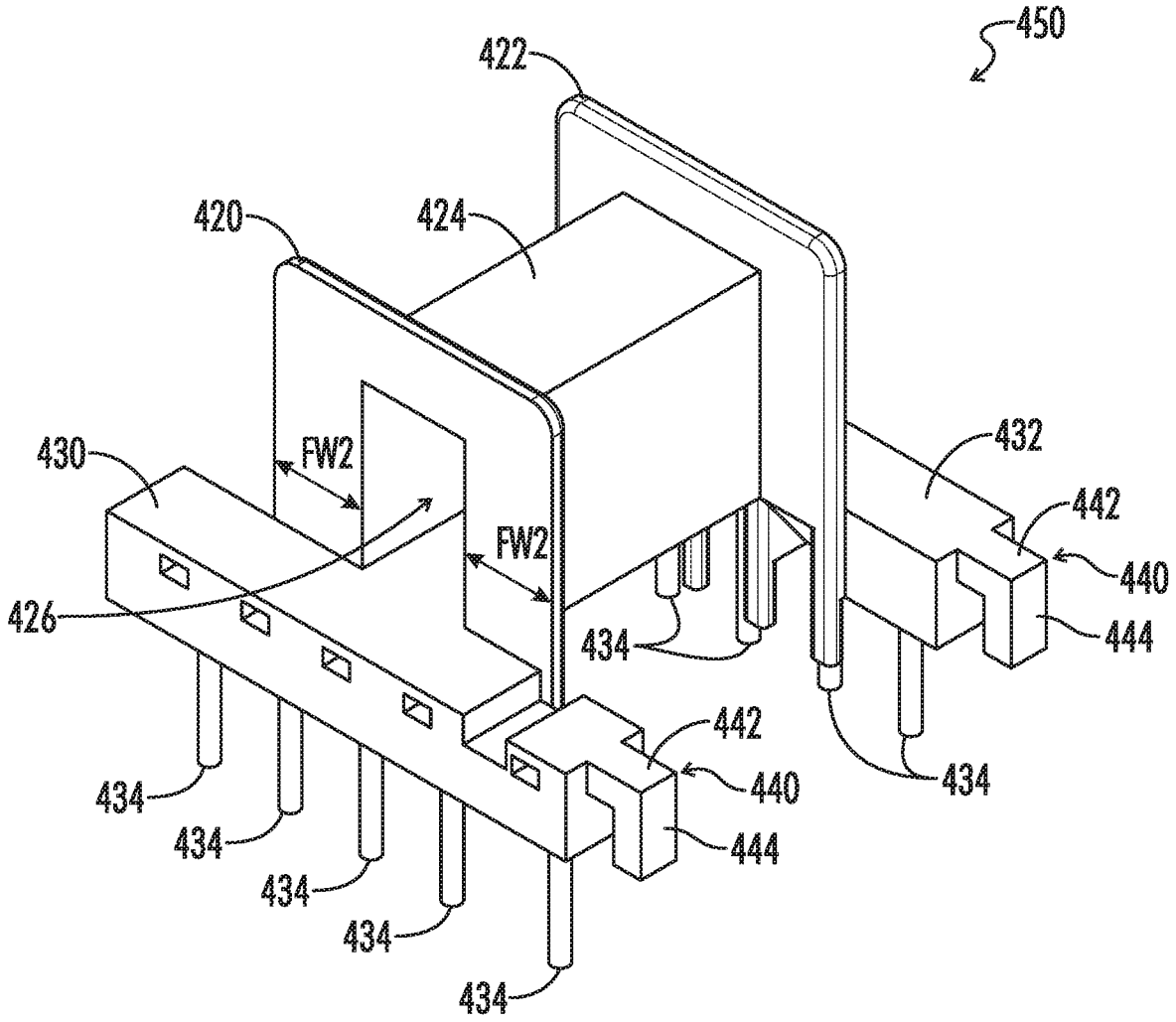
FIG. 12 illustrates an upper rear perspective view of the bobbin of the rightmost magnetic component of FIG. 3

As shown in FIGS. 11 and 12, the second (rightmost) magnetic component 212 (FIG. 3) comprises a second bobbin 450 having a second winding 460. In certain embodiments the second bobbin may differ from the first bobbin 400; however, in the illustrated embodiment, the second bobbin has the same or substantially the same structure as the first bobbin. Accordingly, the first end flange 420, the second end flange 422, the winding surface 424, the passageway 426, the first pin rail 430, the second pin rail 432 and the pins 434 are numbered as described above for the first bobbin. Each flange of the second bobbin has a width FW2 between the passageway and each lateral outer periphery of the flange that is selected to be no more than the common width of the fourth winding window. The second bobbin further includes the engagement device 440 of the first type at the right end of each pin rail. Each engagement device of the first type comprises the outward extending first portion 442 and the downward extending second portion 444 as described above.

When the second bobbin 450 is included as part of the overall magnetic assembly 100 as shown in FIG. 3, the second bobbin is rotated 180 degrees such that the second end flange 422 of the second bobbin faces the front of the magnetic assembly and the first end flange 420 faces the rear of the magnetic assembly. The rotation causes the engagement devices 440 of the first type on the first pin rail 430 and the second pin rail 432 on the second bobbin to extend to the left from the ends of the pin rails.

As shown, for example, in the cross-sectional view in FIG. 17, the passageway 426 of the second bobbin is configured to receive the second outer legs 260 of the first and second core halves 220, 222 such that the third gap 320 formed by the juxtaposed end surfaces of the second outer legs is positioned approximately in the middle of the passageway between the first end flange 420 and the second end flange 422. The rightmost portions of the two flanges and the rightmost portion of the second winding 460 (which are on the left in the rotated position in FIG. 15) fit within the fourth winding window 380 (FIG. 17).

Figure 13:
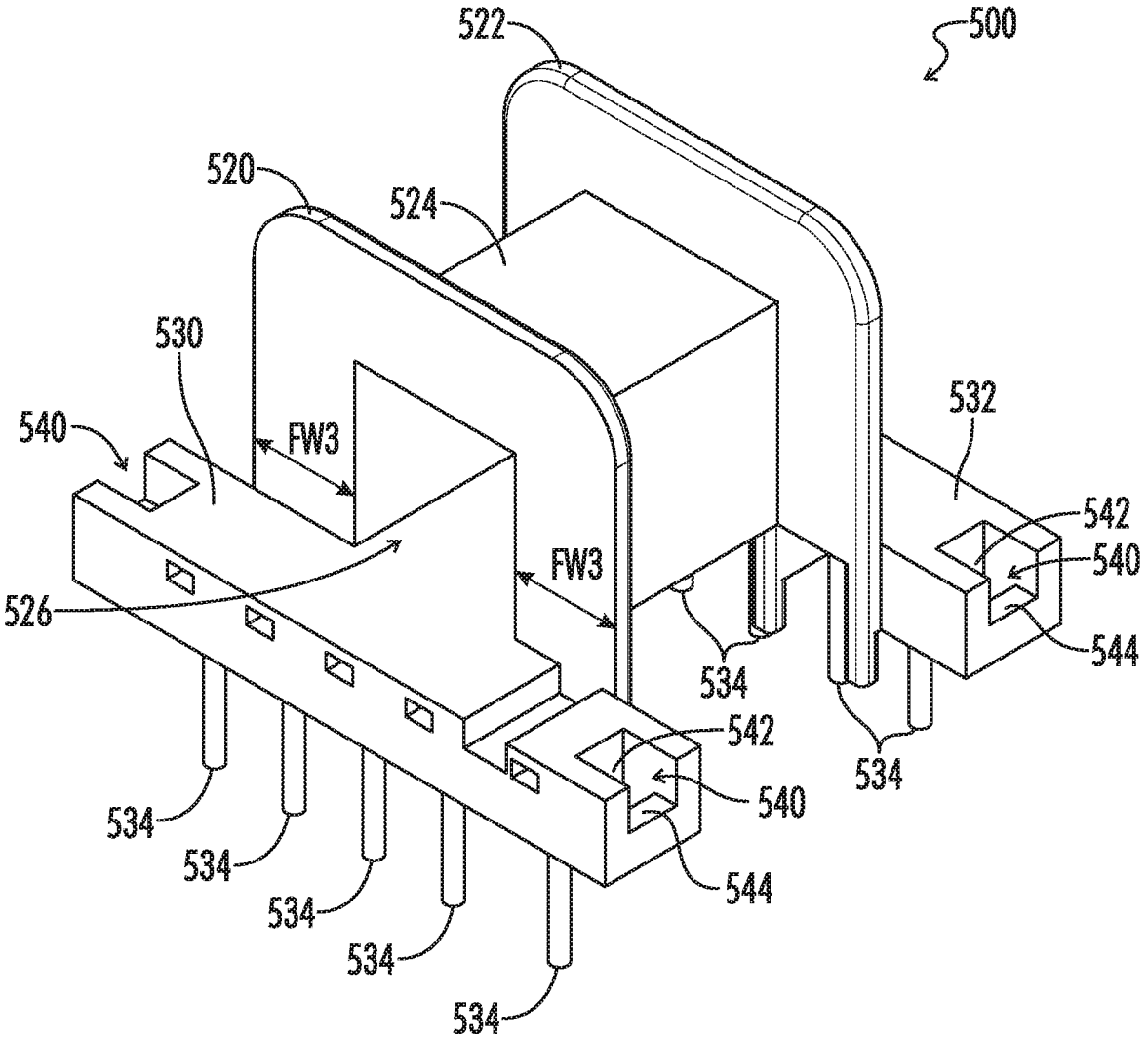
FIG. 13 illustrates an upper front perspective view of the bobbin of the middle magnetic component of FIG. 3.
Figure 14:
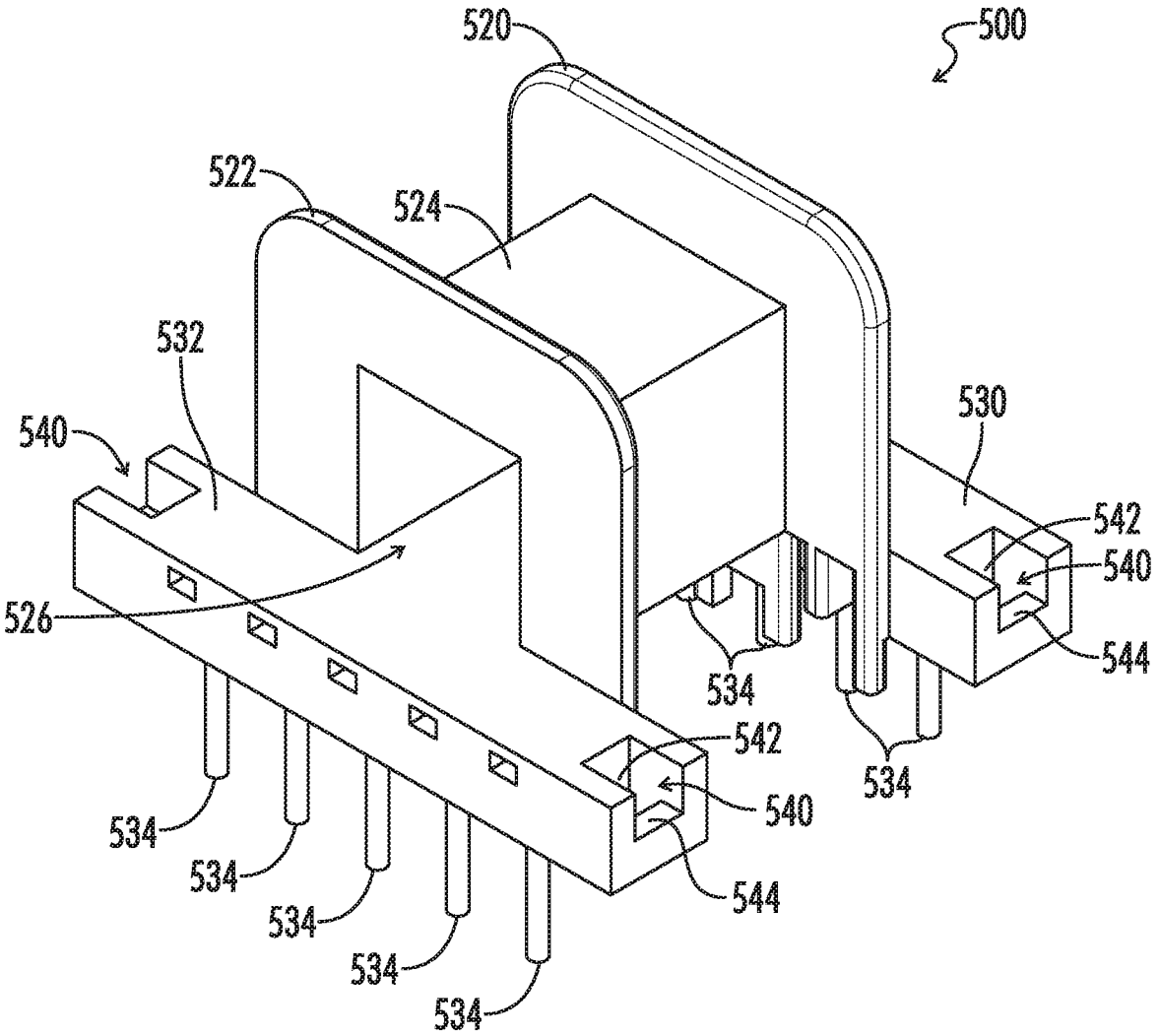
FIG. 14 illustrates an upper rear perspective view of the bobbin of the middle magnetic component of FIG. 3.

As shown in FIGS. 13 and 14, the third (middle) magnetic component 214 comprises a third bobbin 500 having a third winding 510. The third bobbin includes a first end flange 520 and a second end flange 522. A coil winding surface 524 extends between the first end flange and the second end flange. The coil winding surface surrounds a core leg receiving passageway 526. The outer surfaces of the first flange and the second flange of the third bobbin are spaced apart by a distance selected to be less than the lengths of the second winding window 360 and the third winding window 370 of the mated core halves 220, 222 as shown in FIG. 7. Each flange has a width FW3 between the passageway and each lateral outer periphery of the flange that is selected to be no more than the common width of each of the second and third winding windows.

A first pin (or terminal) rail 530 extends from the first end flange 520. A second pin (or terminal) rail 532 extends from the second end flange 522. Each pin rail supports a plurality of pins (or terminals) 534. Selected ones of the pins are electrically connected to the first winding by conductors (not shown) in a conventional manner.

As shown, for example, in the cross-sectional view in FIG. 17, the passageway 526 of the third bobbin 500 has a shape and a size configured to receive the middle legs 270 of the first and second core halves 220, 222 such that the first gap 300 formed by the juxtaposed end surfaces of the middle legs is positioned approximately in the middle of the passageway between the first end flange 520 and the second end flange 522. When positioned as shown in FIG. 17, the respective lateral portions of the flanges and the lateral portions of the winding 510 fit within the second winding window 360 and the third winding window 370.

As further shown in FIGS. 13 and 14, the third bobbin 500 further includes an engagement device 540 of a second type at each end of each of the first pin rail 530 and the second pin rail 532. Accordingly, the third bobbin includes four engagement devices of the second type. In the illustrated embodiment, each engagement device of the second type comprises an opening 542 that extends downwardly through the respective pin rail. Each downwardly extending opening is offset from the end of the respective pin rail by an offset distance. The offset distance is selected to be approximately the same as the offset of the second portions 442 of the engagement device 440 of the first type from the ends of the respective pin rails 430, 432 of the first bobbin 400 and the second bobbin 450. The downwardly extending opening has a shape and size configured to receive a second portion of one of the engagement devices of the first type. A respective notch 544 is formed inwardly from the respective end of each pin rail. The notch extends to the downwardly extending opening. The notch has a width and a depth configured to receive the outwardly extending first portion of one of the engagement devices of the first type.

The structure and positioning of the engagement devices 440 of the first type on the first bobbin 400 and the second bobbin 450 and the engagement devices 550 of the second type on the third bobbin 500 are interconnected as shown in FIG. 15 to align the three bobbins in a proper orientation to receive the first core half 220 and the second core half 222 of the core structure 216. By having an interconnected arrangement, the first, second, and third bobbins can be separately wound prior to being connected. The first bobbin is positioned to the left of the third (middle) bobbin. The downwardly extending second portions 444 of the engagement structures 440 of the first type of the first bobbin at the right ends of the first and second pin rails 430, 432 are aligned with and positioned into the downwardly extending openings 542 of the engagement devices of the second type at the left ends of the pin rails 530, 532 of the third bobbin. The second bobbin is rotated 180 degrees as discussed above and is positioned to the right of the third bobbin. The downwardly extending second portions 444 of the engagement structures 440 of the first type at the left ends (as rotated) of the first and second pin rails 430, 432 of the second bobbin are aligned with and positioned into the downwardly extending openings of the engagement devices of the second type at the right ends of the pin rails of the third bobbin.

The lengths of the respective pin rails 230, 232 of the three bobbins are selected such that when the three bobbins are interlocked using the engagement devices, the first outer legs 250 of the first and second core halves 220, 220 are aligned with the passageway 426 of the first bobbin 400, the middle legs 270 of two core halves are aligned with the passageway 526 of the third bobbin 500, and the second outer legs 260 of the two core halves are aligned with the passageway 426 of the second bobbin 450. Thus, the two core halves are easily inserted into the three passageways in a single operation for each core half. The four windows 350, 360, 370, 380 allow the winding on both sides of the passageway of the third bobbin and the respective inside portions of the windings of the first and second bobbins to fit between adjacent core legs.

FIG. 18 pictorially represents the flux paths through the core structure 216 generated by the respective windings 410, 460, 510 of the magnetic components 210, 212, 214. As shown, the flux generated by the first winding 410 follows a first flux path 700, which passes through the first outer legs 250 positioned within the core leg receiving passageway 426 onto which the first winding is wound, including the second gap 310. The first flux path passes through a region of the body portion 230 of the first core half 220 to the first intermediate legs 280; passes through the first intermediate legs 280; passes through a region of the body portion 230 of the second core half 222; and passes back to the first outer legs positioned within the first winding. Accordingly, the first flux path encompasses the first winding window 350.

Similarly, the flux generated by the second winding 460 follows a second flux path 710, which passes through the second outer legs 260 positioned within the core leg receiving passageway 426 onto which the second winding is wound, including the third gap 320. The second flux path passes through a region of the body portion 230 of the first core half 220 to the second intermediate legs 290; passes through the second intermediate legs; passes through a region of the body portion 230 of the second core half 222; and passes back to the second outer legs positioned within the second winding. Accordingly, the second flux path encompasses the fourth winding window 380.

The flux generated by the third winding 510 follows a third flux path 720, which passes through the middle legs 270 positioned within the core leg receiving passageway 526 onto which the third winding is wound, including the first gap 300. The third flux path splits such that a first portion 720A of the third flux path passes through a portion of the body portion 230 of the first core half to the first intermediate legs 280 and a second portion 720B of the third flux path passes through another portion of the body portion of the first core half to the second intermediate legs 290. The first and second portions of the third flux path pass through respective portions of the body portion 230 of the second core half 222 and are recombined to pass back to the middle legs positioned within the third winding. Accordingly, the first portion 720A of the third flux path 720 encompasses the second winding window 360, and the second portion 720B of the third flux path 720 encompasses the third winding window 370.

As illustrated in FIG. 18, a first portion of the flux generated by the third winding passes along the first portion 720A of the third flux path 720 through the first intermediary leg 280 with the flux from the first winding 410. Similarly, a second portion of the flux generated by the third winding passes along the second portion 720B of the third flux path through the second intermediary leg 290 with the flux generated by the second winding 460. The cross-sectional areas of the first intermediary leg and the second intermediary legs are selected to be sufficiently great such that the first and second intermediary legs are able to accommodate the flux generated by the two windings without exceeding a desired flux density. The cross-sectional surface area of the first intermediate leg is equal to at least the cross-sectional area of the first outer leg 250 plus one-half of the cross-sectional area of the middle leg 270. The cross-sectional surface area of the second intermediate leg is equal to at least the cross-sectional area of the second outer leg 260 plus one-half of the cross-sectional area of the middle leg. As further illustrated in FIG. 18, the flux generated by two sources for each intermediary leg pass through the intermediary leg within separate portions of the intermediary leg and do not interact.

One benefit of the magnetic assembly 200 disclosed herein is illustrated pictorially in FIG. 19, which shows the first magnetic assembly 110, the second magnetic assembly 112 and the third magnetic assembly 114 of FIGS. 1A and 1B replaced with the single magnetic assembly 200 of FIG. 2. As illustrated, a first structural gap 600 between the first magnetic assembly and the second magnetic assembly and a second structural gap 610 between the second magnetic assembly and the third magnetic assembly are eliminated by the improved single core structure. Furthermore, the new core structure eliminates the first outer legs 144A, 154A of the E-cores of the first magnetic assembly and the second outer legs 146C, 156C of the E-cores of the third magnetic assembly. Thus, the overall structure requires less area on a printed circuit board. Furthermore, the installation steps are reduced by having to install only a single magnetic component instead of three magnetic components.

Thus, although there have been described particular embodiments of the present invention of a new and useful "Single Magnetic Assembly Combining Three Independent Magnetics Using a Modified "E" Core with Four Winding Windows," it is not intended that such references be construed as limitations upon the scope of this invention except as set forth in the following claims.

What is claimed is:

1. A magnetic assembly having three independent magnetic components sharing a common core structure, the magnetic assembly comprising:

a first bobbin having a first winding surrounding a respective passageway, the passageway having a first bobbin passageway profile, the first bobbin having at least one latch mechanism of a first type;

a second bobbin having a second winding surrounding a respective passageway, the passageway having a second bobbin passageway profile, the second bobbin having at least one latch mechanism of the first type;

a third bobbin having a third winding surrounding a respective passageway, the passageway having a third bobbin passageway profile, the third bobbin having at least a first latch mechanism of a second type configured to engage the latch mechanism of the first type of the first bobbin, the third bobbin having at least a second latch mechanism of the second type configured to engage the latch mechanism of the first type of the second bobbin; and a first core half and a second core half, each of the first core half and the second core half including:

a main core body extending in a first direction between a first end of the main core body and a second end of the main core body;

a first outer leg extending perpendicularly from the main core body in a second direction perpendicular to the first direction, the first outer leg positioned proximate to the first end of the main core body, the first outer leg having a first outer leg cross-sectional profile configured to fit within the passageway of the first bobbin;

a second outer leg extending perpendicularly from the main core body in the second direction, the second outer leg positioned proximate to the second end of the main core body, the second outer leg having a second outer leg cross-sectional profile configured to fit within the passageway of the second bobbin;

a middle leg extending perpendicularly from the main core body in the second direction, the middle leg positioned between the first outer leg and the second outer leg, the middle leg having a middle leg cross-sectional profile configured to fit within the passageway of the third bobbin;

a first intermediate leg extending perpendicularly from the main core body in the second direction, the first intermediate leg positioned between the first outer leg and the middle leg, the first intermediate leg spaced apart from the first outer leg by a first leg spacing, the first intermediate leg spaced apart from the middle leg by a second leg spacing, the first intermediate leg having a first intermediate leg cross-sectional profile, the first intermediate leg having a respective end surface; and a second intermediate leg extending perpendicularly from the main core body in the second direction, the second intermediate leg positioned between the middle leg and the second outer leg, the second intermediate leg spaced apart from the middle leg by a third leg spacing, the second intermediate leg spaced apart from the second outer leg by a fourth leg spacing, the second intermediate leg having a second intermediate leg cross-sectional profile, the second intermediate leg having a respective end surface;

wherein:

the first bobbin includes a respective first end flange and a respective second end flange positioned at opposite ends of the passageway of the first bobbin, each end flange of the first bobbin including a first bobbin flange width defined between the passageway and a lateral outer periphery of the respective end flange, the first bobbin flange width equal to the first leg spacing;

the second bobbin includes a respective first end flange and a respective second end flange positioned at opposite ends of the passageway of the second bobbin, each end flange of the second bobbin including a second bobbin flange width defined between the passageway and a lateral outer periphery of the respective end flange, the second bobbin flange width equal to the fourth leg spacing; and the third bobbin includes a respective first end flange and a respective second end flange positioned at opposite ends of the passageway of the third bobbin, each end flange of the third bobbin including a third bobbin flange width defined between the passageway and a lateral outer periphery of the respective end flange, the third bobbin flange width equal to the second leg spacing and equal to the third leg spacing.

2. The magnetic assembly of claim 1, wherein:

the first outer leg cross-sectional profile defines a first outer leg cross-sectional area;

the second outer leg cross-sectional profile defines a second outer leg cross-sectional area;

the middle leg cross-sectional profile defines a middle leg cross-sectional area;

the first intermediate leg cross-sectional profile defines a first intermediate leg cross-sectional area, the first intermediate leg cross-sectional area being at least as great as the sum of the first outer leg cross-sectional area and half of the middle leg cross-sectional area; and the second intermediate leg cross-sectional profile defines a second intermediate leg cross-sectional area, the second intermediate leg cross-sectional area being at least as great as the sum of the second outer leg cross-sectional area and half of the middle leg cross-sectional area.

3. The magnetic assembly of claim 2, wherein:

the first leg spacing is equal to the fourth leg spacing;

the first outer leg cross-sectional area is equal to the second outer leg cross-sectional area; and the first intermediate leg cross-sectional area is equal to the second intermediate leg cross-sectional area.

4. The magnetic assembly of claim 1, wherein:

the first outer leg of each core half is configured to be inserted into the passageway of the first bobbin;

the second outer leg of each core half is configured to be inserted into the passageway of the second bobbin;

the middle leg of each core half is configured to be inserted into the passageway of the third bobbin;

the first intermediate leg of each core half configured to span between the first bobbin and the third bobbin with the respective end surface of the first intermediate leg of the first core half abutting the respective end surface of the first intermediate leg of the second core half; and the second intermediate leg of each core half configured to span between the second bobbin and the third bobbin with the respective end surface of the second intermediate leg of the first core half abutting the respective end surface of the second intermediate leg of the second core half.

5. The magnetic assembly of claim 1, wherein the first bobbin flange width is equal to the third bobbin flange width.

6. The magnetic assembly of claim 1, wherein the main core body has a selected common height.

7. The magnetic assembly of claim 1, wherein:

the first outer legs and the first intermediate legs of the first and second core halves define a first winding window having the first leg spacing;

the first intermediate legs and the middle legs of the first and second core halves define a second winding window having the second leg spacing;

the middle legs and the second intermediate legs of the first and second core halves define a third winding window having the third leg spacing; and the second intermediate legs and the second outer legs of the first and second core halves define a fourth winding window having the fourth leg spacing.

8. The magnetic assembly of claim 7, wherein the first leg spacing is equal to the fourth leg spacing.

9. A magnetic assembly having three independent magnetic components sharing a common core structure, the magnetic assembly comprising:

a first bobbin having a first winding surrounding a respective passageway, the passageway having a first bobbin passageway profile, the first bobbin having at least one latch mechanism of a first type;

a second bobbin having a second winding surrounding a respective passageway, the passageway having a second bobbin passageway profile, the second bobbin having at least one latch mechanism of the first type;

a third bobbin having a third winding surrounding a respective passageway, the passageway having a third bobbin passageway profile, the third bobbin having at least a first latch mechanism of a second type configured to engage the latch mechanism of the first type of the first bobbin, the third bobbin having at least a second latch mechanism of the second type configured to engage the latch mechanism of the first type of the second bobbin; and a first core half and a second core half, each of the first core half and the second core half including:

a main core body extending in a first direction between a first end of the main core body and a second end of the main core body;

a first outer leg extending perpendicularly from the main core body in a second direction perpendicular to the first direction, the first outer leg positioned proximate to the first end of the main core body, the first outer leg having a first outer leg cross-sectional profile configured to fit within the passageway of the first bobbin;

a second outer leg extending perpendicularly from the main core body in the second direction, the second outer leg positioned proximate to the second end of the main core body, the second outer leg having a second outer leg cross-sectional profile configured to fit within the passageway of the second bobbin;

a middle leg extending perpendicularly from the main core body in the second direction, the middle leg positioned between the first outer leg and the second outer leg, the middle leg having a middle leg cross-sectional profile configured to fit within the passageway of the third bobbin;

a first intermediate leg extending perpendicularly from the main core body in the second direction, the first intermediate leg positioned between the first outer leg and the middle leg, the first intermediate leg spaced apart from the first outer leg by a first leg spacing, the first intermediate leg spaced apart from the middle leg by a second leg spacing, the first intermediate leg having a first intermediate leg cross-sectional profile, the first intermediate leg having a respective end surface; and a second intermediate leg extending perpendicularly from the main core body in the second direction, the second intermediate leg positioned between the middle leg and the second outer leg, the second intermediate leg spaced apart from the middle leg by a third leg spacing, the second intermediate leg spaced apart from the second outer leg by a fourth leg spacing, the second intermediate leg having a second intermediate leg cross-sectional profile, the second intermediate leg having a respective end surface;

wherein:

the first bobbin has a respective first pin rail and a respective second pin rail, each pin rail extending perpendicularly to the passageway of the first bobbin, each pin rail having a respective latch mechanism of the first type at a respective first end;

the second bobbin has a respective first pin rail and a respective second pin rail, each pin rail extending perpendicularly to the passageway of the second bobbin, each pin rail having a respective latch mechanism of the first type at a respective first end; and the third bobbin has a respective first pin rail and a respective second pin rail, each pin rail extending perpendicularly to the passageway of the third bobbin, each pin rail having a respective latch mechanism of the second type at a respective first end and at a respective second end, each latch mechanism of the second type configured to receive and engage a respective latch mechanism of the first type.

* * * * *